US009857732B2

(12) United States Patent
Shimizu et al.

(10) Patent No.: US 9,857,732 B2
(45) Date of Patent: Jan. 2, 2018

(54) DEVELOPING DEVICE AND IMAGE FORMING APPARATUS PROVIDED WITH SAME

(71) Applicant: KYOCERA Document Solutions Inc., Osaka-shi, Osaka (JP)

(72) Inventors: Tamotsu Shimizu, Osaka (JP); Kenichi Tamaki, Osaka (JP)

(73) Assignee: KYOCERA DOCUMENT SOLUTIONS INC., Osaka-shi, Osaka (JP)

( * ) Notice: Subject to any disclaimer, the term of this patent is extended or adjusted under 35 U.S.C. 154(b) by 0 days.

(21) Appl. No.: 15/456,965

(22) Filed: Mar. 13, 2017

(65) Prior Publication Data

US 2017/0269509 A1 Sep. 21, 2017

(30) Foreign Application Priority Data

Mar. 17, 2016 (JP) ..... 2016-053274
Mar. 17, 2016 (JP) ..... 2016-053657
Mar. 17, 2016 (JP) ..... 2016-053951

(51) Int. Cl.
*G03G 15/08* (2006.01)
*G03G 15/09* (2006.01)

(52) U.S. Cl.
CPC ..... *G03G 15/0889* (2013.01); *G03G 15/0812* (2013.01); *G03G 15/0907* (2013.01); *G03G 15/0921* (2013.01)

(58) Field of Classification Search
CPC ..... G03G 15/0889; G03G 15/0812; G03G 15/0907; G03G 15/0921
See application file for complete search history.

(56) References Cited

U.S. PATENT DOCUMENTS 4,218,691 A * 8/1980 Fujii ..... G03G 15/0928 347/55
4,383,497 A * 5/1983 Tajima ..... G03G 15/0808 399/276
4,624,559 A * 11/1986 Haneda ..... G03G 15/0812 118/624
4,669,852 A * 6/1987 Tajima ..... G03G 15/081 399/282

(Continued)

FOREIGN PATENT DOCUMENTS

JP 4-107586 4/1992

*Primary Examiner* — G. M. Hyder
(74) *Attorney, Agent, or Firm* — Gerald E. Hespos; Michael J. Porco; Matthew T. Hespos

(57) ABSTRACT

A developing device includes a developing roller and a conveyor roller. The developing roller includes a first magnet. The conveyor roller includes a second magnet. The first magnet includes a first magnetic pole and a second magnetic pole. The second magnet includes a third magnetic pole and a fourth magnetic pole. The first and fourth magnetic poles are magnetic poles having the same polarity. One of the second and third magnetic poles is a magnetic pole having the same polarity as the first magnetic pole. The other of the second and third magnetic poles is a magnetic pole having a polarity different from the first magnetic pole. The developer is transferred from the conveyor roller to the developing roller by the third and second magnetic poles. The developer is transferred from the developing roller to the conveyor roller by the first and fourth magnetic poles.

20 Claims, 22 Drawing Sheets

(56) References Cited

U.S. PATENT DOCUMENTS

| | | | | | |
|---|---|---|---|---|---|
| 5,545,840 | A * | 8/1996 | Doi | G03G 15/09 | 399/274 |
| RE38,026 | E * | 3/2003 | Tada | G03G 15/09 | 399/274 |
| 6,671,483 | B2 * | 12/2003 | Meyer | G03G 15/09 | 399/274 |
| 2014/0140739 | A1 * | 5/2014 | Sato | G03G 15/0921 | 399/269 |
| 2017/0269508 | A1 * | 9/2017 | Shimizu | G03G 15/0907 | |
| 2017/0269510 | A1 * | 9/2017 | Tamaki | G03G 15/0889 | |

* cited by examiner

DEVELOPING DEVICE AND IMAGE FORMING APPARATUS PROVIDED WITH SAME

This application is based on Japanese Patent Applications Nos. 2016-053951, 2016-053274 and 2016-053657 filed with the Japan Patent Office on Mar. 17, 2016, the contents of which are hereby incorporated by reference.

BACKGROUND

The present disclosure relates to a developing device and an image forming apparatus provided with the same.

Conventionally, an electrophotographic image forming apparatus such as a printer or a copier includes a photoconductive drum for carrying an electrostatic latent image, a developing device for developing an electrostatic latent image into a toner image by supplying toner to the photoconductive drum and a transfer device for transferring a toner image from the photoconductive drum to a sheet.

The developing device includes a developing roller for supplying toner to a photoconductive drum and a conveyor roller for supplying developer to the developing roller. Further, each of the developing roller and the conveyor roller includes a fixed magnet having a plurality of magnetic poles and a sleeve configured to rotate around the magnet. The developer is supplied from the conveyor roller to the developing roller by a magnetic force generated between a first S pole on the side of the conveyor roller and a first N pole on the side of the developing roller. Further, the developer is collected from the developing roller to the conveyor roller by a magnetic force generated between a second N pole on the side of the developing roller and a second S pole on the side of the conveyor roller.

SUMMARY

A developing device according to one aspect of the present disclosure includes a developing roller, a conveyor roller and a developer stirring unit. The developing roller is arranged to face a photoconductive drum, on a surface of which an electrostatic latent image is to be formed, at a predetermined developing position and supplies the toner to the photoconductive drum. The developing roller includes a fixed first magnet having a plurality of magnetic poles along a circumferential direction and a first sleeve configured to rotate in a first rotational direction around the first magnet and carry developer containing toner and magnetic carrier on a peripheral surface. The conveyor roller supplies the developer to the developing roller. The conveyor roller includes a fixed second magnet having a plurality of magnetic poles along a circumferential direction and a second sleeve configured to rotate in a second rotational direction around the second magnet and carry the developer on a peripheral surface. The developer stirring unit stirs the developer and supplies the developer to the conveyor roller. The first and second rotational directions are set to be opposite to each other at the facing position. The first magnet includes a first magnetic pole arranged upstream of the facing position in the first rotational direction and a second magnetic pole arranged adjacent to and downstream of the first magnetic pole in the first rotational direction across the facing position. The second magnet includes a third magnetic pole arranged upstream of the facing position in the second rotational direction, and a fourth magnetic pole arranged adjacent to and downstream of the third magnetic pole in the second rotational direction across the facing position. The first and fourth magnetic poles are magnetic poles having the same polarity. One of the second and third magnetic poles is a magnetic pole having the same polarity as the first magnetic pole. The other of the second and third magnetic poles is a magnetic pole having a polarity different from the first magnetic pole. The developer supplied from the developer stirring unit to the conveyor roller is transferred from the conveyor roller to the developing roller by a magnetic field formed by the third and second magnetic poles. The developer having passed through the developing position is transferred from the developing roller to the conveyor roller by a magnetic field formed by the first and fourth magnetic poles.

Further, an image forming apparatus according to another aspect of the present disclosure includes the above developing device, the photoconductive drum configured to receive the supply of the toner from the developing device and carry a toner image on the peripheral surface and a transfer unit configured to transfer the toner image from the photoconductive drum to a sheet.

DETAILED DESCRIPTION

Hereinafter, an image forming apparatus 10 according to a first embodiment of the present disclosure is described in detail based on the drawings. In this embodiment, a tandem color printer is illustrated as an example of the image forming apparatus. The image forming apparatus may be, for example, a copier, a facsimile machine, a complex machine of these or the like.

Figure 1:
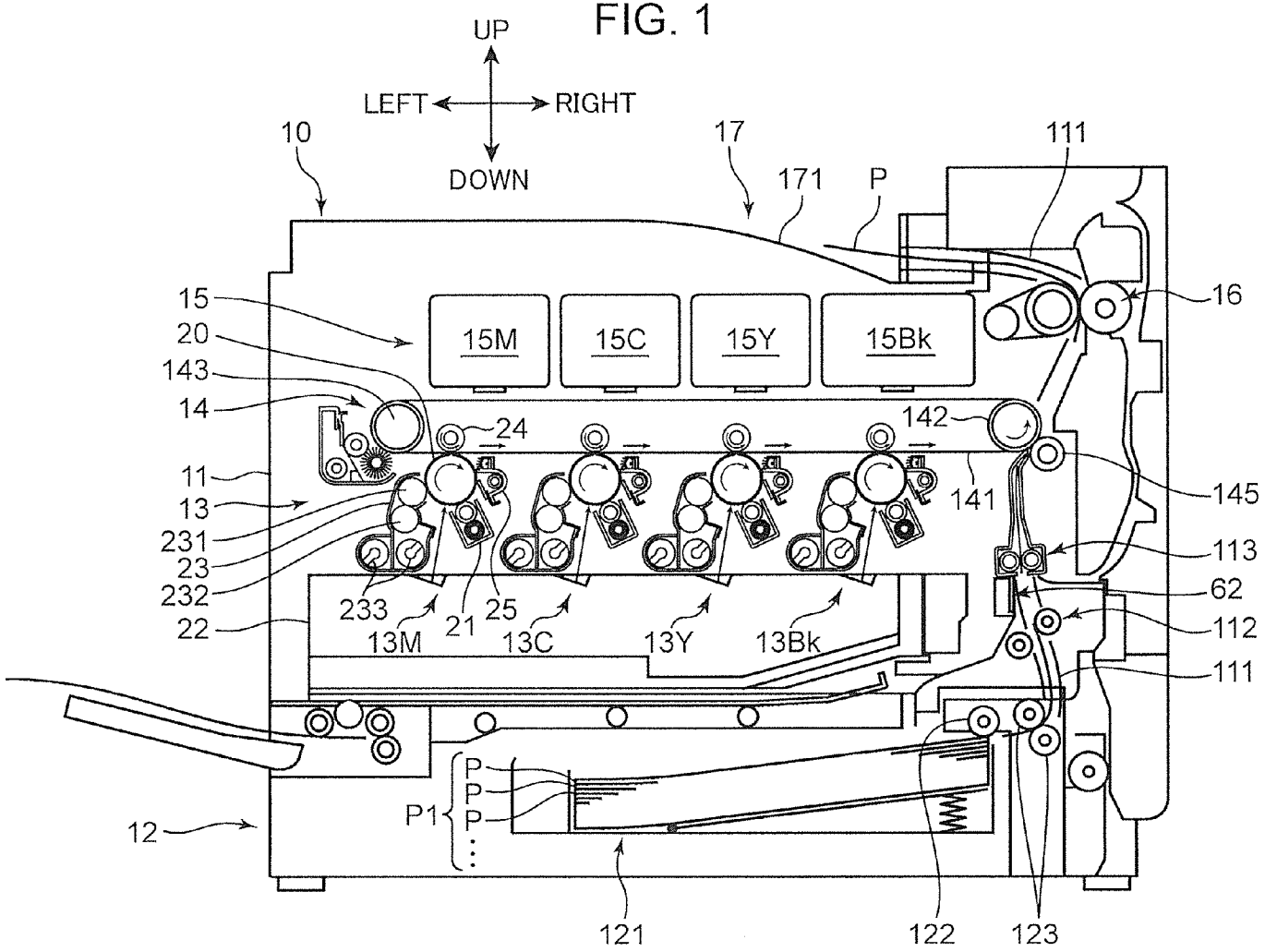
FIG. 1 is a sectional view showing an internal structure of an image forming apparatus according to a first embodiment of the present disclosure.

FIG. 1 is a sectional view showing an internal structure of the image forming apparatus 10. This image forming apparatus 10 includes an apparatus body 11 having a box-shaped housing structure. A sheet feeding unit 12 for feeding a sheet P, an image forming station 13 for forming a toner image to be transferred to the sheet P fed from the sheet feeding unit 12, an intermediate transfer unit 14 to which the toner image is to be primarily transferred, a second transfer roller 145, a toner supplying unit 15 for supplying toner to the image forming station 13 and a fixing unit 16 for fixing an unfixed toner image formed on the sheet P to the sheet P are housed in this apparatus body 11. Further, a sheet discharging unit 17 to which the sheet P having a fixing process applied thereto in the fixing unit 16 is to be discharged is provided on a top part of the apparatus body 11.

A sheet conveyance path 111 extending in a vertical direction is formed at a position to the right of the image forming station 13 in the apparatus body 11. A conveyor roller pair 112 for conveying a sheet is disposed at a suitable position of the sheet conveyance path 111. A registration roller pair 113 for correcting the skew of the sheet and feeding the sheet to a secondary transfer nip portion to be described later at a predetermined timing is also provided upstream of the nip portion in the sheet conveyance path 111. The sheet conveyance path 111 is a conveyance path for conveying the sheet P from the sheet feeding unit 12 to the sheet discharging unit 17 by way of the image forming station 13 (secondary transfer nip portion) and the fixing unit 16.

The sheet feeding unit 12 includes a sheet feed tray 121, a pickup roller 122 and a sheet feed roller pair 123. The sheet feed tray 121 is detachably mounted at a lower position of the apparatus body 11 and stores a sheet bundle P1 in which a plurality of sheets P are stacked. The pickup roller 122 picks up the uppermost sheet of the sheet bundle P1 stored in the sheet feed tray 121 one by one. The sheet feed roller pair 123 feeds the sheet P picked up by the pickup roller 122 to the sheet conveyance path 111.

The image forming station 13 is for forming a toner image to be transferred to a sheet P and includes a plurality of image forming units for forming toner images of different colors. As these image forming units, a magenta unit 13 using developer of magenta (M), a cyan unit 13C using developer of cyan (C), a yellow unit 13Y using developer of yellow (Y) and a black unit 13Bk using developer of black (Bk) successively arranged from an upstream side toward a downstream side (from a left side to a right side shown in FIG. 1) in a rotational direction of an intermediate transfer belt 141 to be described later are provided in this embodiment. Each of the units 13M, 13C, 13Y and 13Bk includes a photoconductive drum 20 and a charging device 21, a developing device 23 and a cleaning device 25 arranged around the photoconductive drum 20. Further, an exposure device 22 common to each unit 13M, 13C, 13Y, 13Bk is arranged below the image forming units.

The photoconductive drum 20 is rotationally driven about an axis thereof and an electrostatic latent image and a toner image are formed on a peripheral surface thereof. A photoconductive drum using an amorphous silicon (a-Si) based material can be used as this photoconductive drum 20. Each photoconductive drum 20 is arranged to correspond to the image forming unit of each color. The charging device 21 uniformly charges the surface of the photoconductive drum 20. The charging device 21 includes a charging roller and a charge cleaning brush for removing the toner adhering to the charging roller. The exposure device 22 includes various optical devices such as a light source, a polygon mirror, a reflection mirror and a deflection mirror and forms an electrostatic latent image by irradiating light modulated based on image data to the uniformly charged peripheral surface of the photoconductive drum 20. Further, the cleaning device 25 cleans the peripheral surface of the photoconductive drum 20 after the transfer of the toner image.

The developing device 23 supplies the toner to the peripheral surface of the photoconductive drum 20 to develop the electrostatic latent image formed on the photoconductive drum 20. The developing device 23 is for two-component developer composed of toner and carrier. Note that the toner has a property of being positively charged in this embodiment.

The intermediate transfer unit 14 is arranged in a space provided between the image forming station 13 and the toner supplying unit 15. The intermediate transfer unit 14 includes the intermediate transfer belt 141, a drive roller 142, a driven roller 143 and a primary transfer roller 24.

The intermediate transfer belt 141 is an endless belt-like rotary body and mounted between the drive roller 142 and the driven roller 143 such that a peripheral surface thereof is held in contact with the peripheral surface of each photoconductive drum 20. The intermediate transfer belt 141 is driven to turn in one direction and carries a toner image transferred from the photoconductive drums 20 on a surface.

The drive roller 142 stretches the intermediate transfer belt 141 at a right end side of the intermediate transfer unit 14 and drives and rotates the intermediate transfer belt 141. The drive roller 142 is formed of a metal roller. The driven roller 143 stretches the intermediate transfer belt 141 at a left end side of the intermediate transfer unit 14. The driven roller 143 applies a tension to the intermediate transfer belt 141.

The primary transfer roller 24 forms a primary transfer nip portion by sandwiching the intermediate transfer belt 141 between the primary transfer roller 24 and the photoconductive drum 20 and primarily transfers the toner image on the photoconductive drum 20 onto the intermediate transfer belt 141. Each primary transfer roller 24 is arranged to face the photoconductive drum 20 of each color.

The secondary transfer roller 145 is arranged to face the drive roller 142 across the intermediate transfer belt 141. The secondary transfer roller 145 forms the secondary transfer nip portion by being pressed into contact with the peripheral surface of the intermediate transfer belt 141. The toner image primarily transferred onto the intermediate transfer belt 141 is secondarily transferred to the sheet P supplied from the sheet feeding unit 12 in the secondary transfer nip portion. The intermediate transfer unit 14 and the secondary transfer roller 145 of this embodiment constitute a transfer unit of the present disclosure. The transfer unit transfers the toner image to the sheet P from the photoconductive drums 20.

The toner supplying unit 15 is for storing toner used for image formation and includes a magenta toner container 15M, a cyan toner container 15C, a yellow toner container 15Y and a black toner container 15Bk in this embodiment. These toner containers 15M, 15C, 15Y and 15Bk supply the toner of the respective colors to the developing devices 23 of the image forming units 13M, 13C, 13Y, 13Bk corresponding to the respective colors of MCYBk through unillustrated toner conveying units.

The sheet P supplied to the fixing unit 16 is heated and pressed by passing through a fixing nip portion. In this way, the toner image transferred to the sheet P in the secondary transfer nip portion is fixed to the sheet P.

The sheet discharging unit 17 is formed by recessing a top part of the apparatus body 11 and a sheet discharge tray 171 for receiving the discharged sheet P is formed on a bottom part of this recess. The sheet P having a fixing process applied thereto is discharged toward the sheet discharge tray 171 by way of the sheet conveyance path 111 extending from the top of the fixing unit 16.

Figure 2:
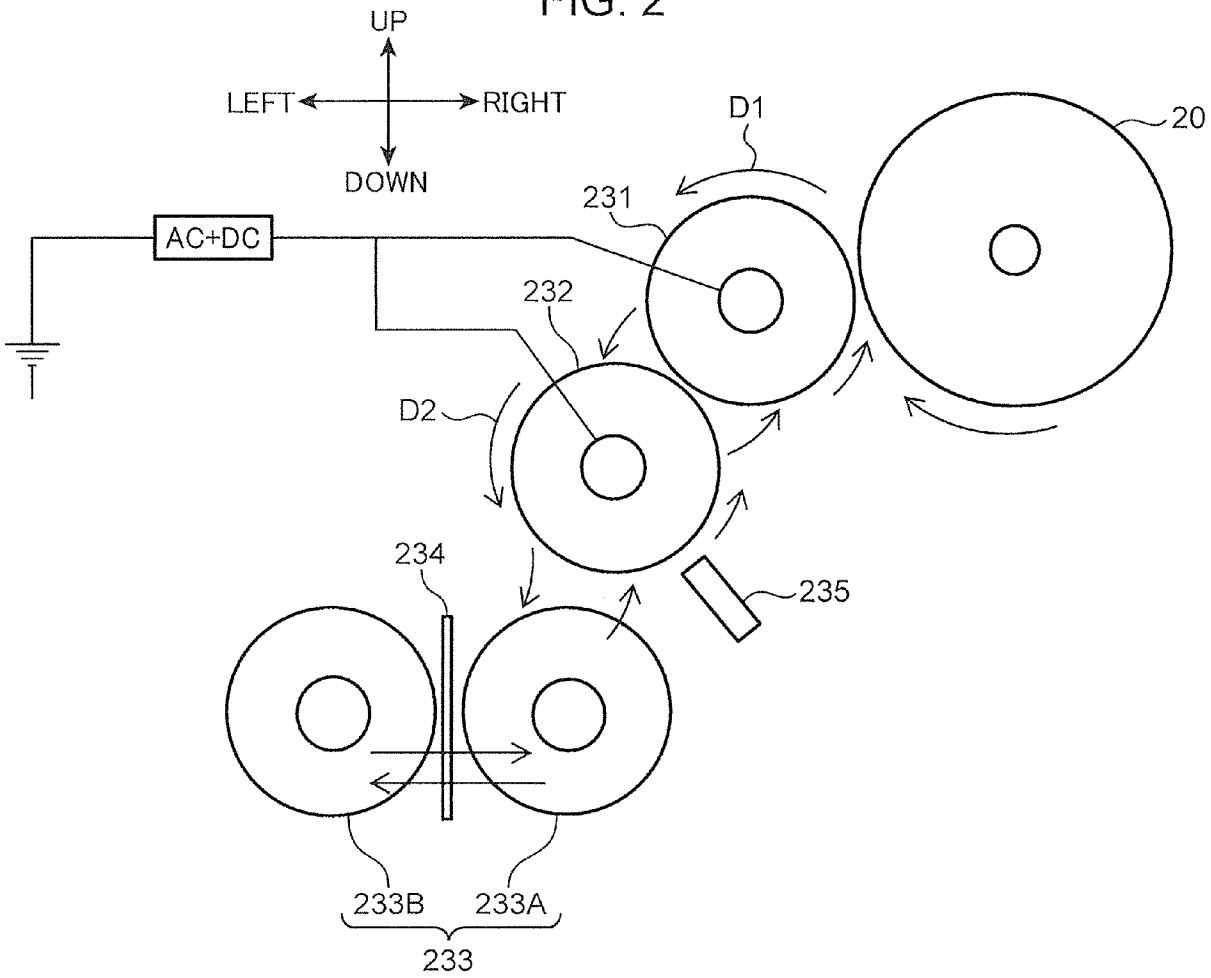
FIG. 2 is a schematic sectional view showing an internal structure of a developing device according to the first embodiment of the present disclosure.
Figure 3:
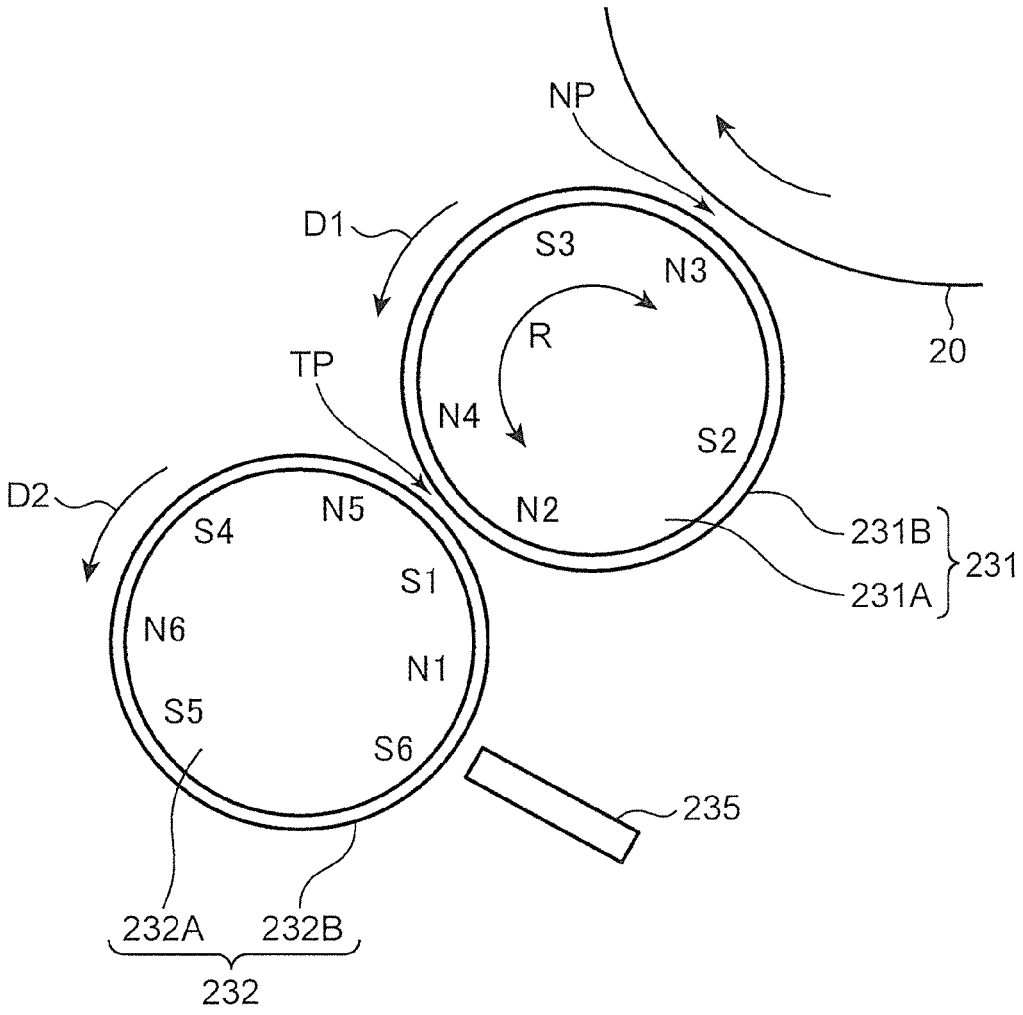
FIG. 3 is a schematic sectional view showing the arrangements of magnetic poles of a developing roller and a conveyor roller according to the first embodiment of the present disclosure.
Figure 4:
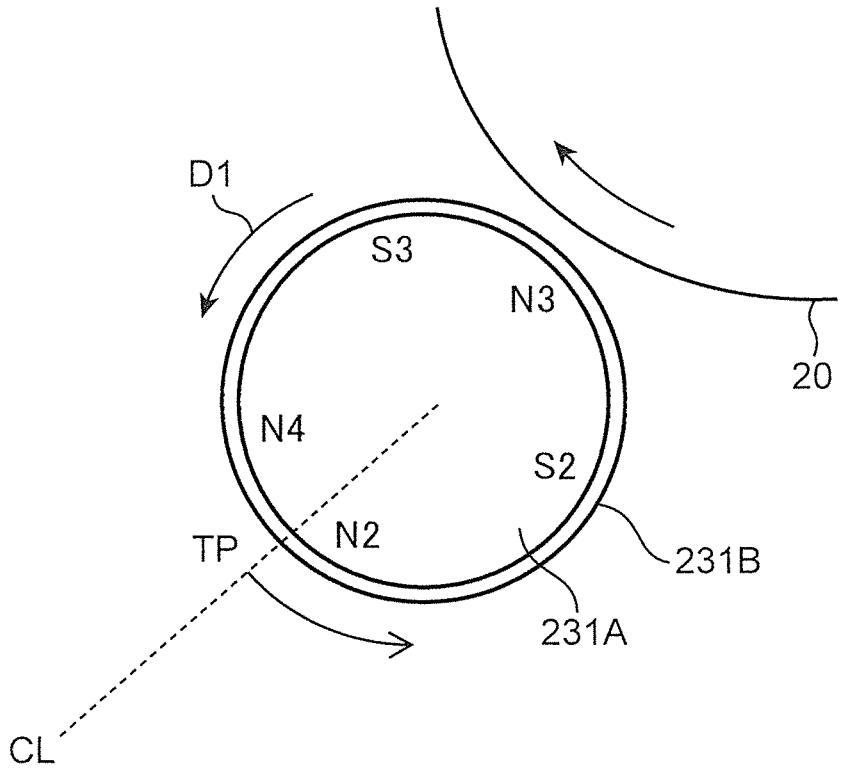
FIG. 4 is a schematic sectional view showing the arrangement of the magnetic poles of the developing roller according to the first embodiment of the present disclosure.
Figure 5:
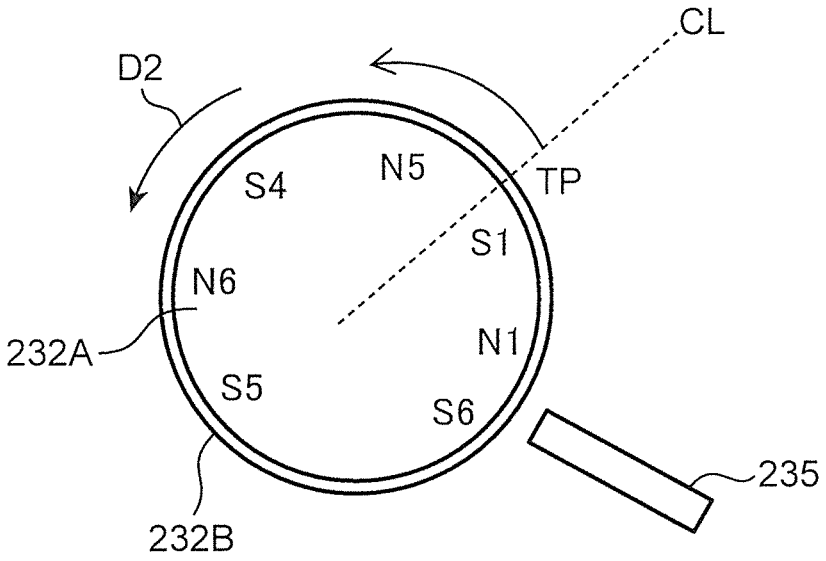
FIG. 5 is a schematic sectional view showing the arrangement of the magnetic poles of the conveyor roller according to the first embodiment of the present disclosure.
Figure 6:
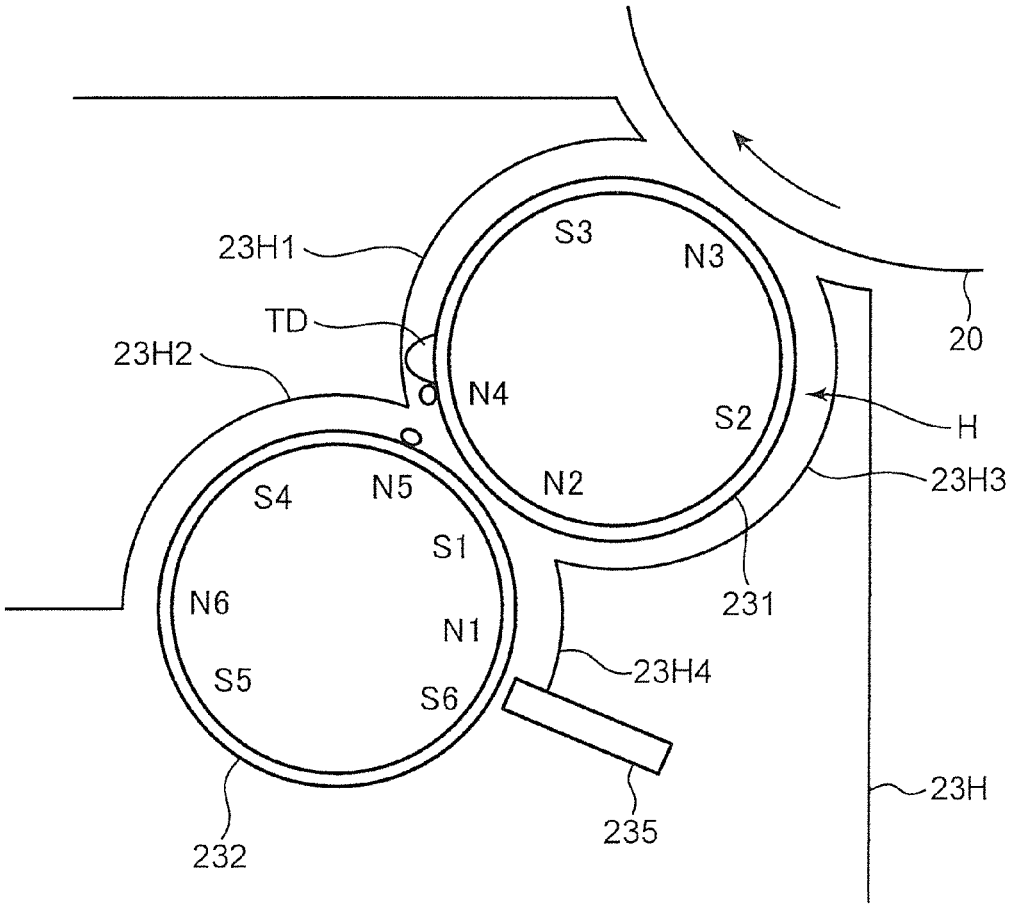
FIG. 6 is a schematic sectional view showing a state where a developer pool is generated in the developing device according to the first embodiment of the present disclosure.

Next, the developing device 23 according to this embodiment is further described in detail with reference to FIGS. 2 to 6 in addition to FIG. 1. FIG. 2 is a schematic sectional view showing an internal structure of the developing device 23 according to this embodiment. In FIG. 2, a rotational direction of each rotary member of the developing device 23 is shown by an arrow. FIG. 3 is a schematic sectional view showing the arrangements of magnetic poles of a developing roller 231 and a conveyor roller 232 according to the this embodiment. FIG. 4 is a schematic sectional view showing the arrangement of the magnetic poles of the developing roller 231. FIG. 5 is a schematic sectional view showing the arrangement of the magnetic poles of the conveyor roller 232. FIG. 6 is a schematic sectional view showing a state where a developer pool (retention portion TD) is generated in the developing device 23 according to this embodiment.

With reference to FIGS. 1 to 6, the developing device 23 includes a housing 23H, the developing roller 231, the conveyor roller 232, a stirring screw 233 (developer stirring unit) with two screws, a partition plate 234 and a layer thickness regulating member 235. The housing 23H is a casing body for supporting each member of the developing device 23.

The developing roller 231 is arranged to face the photoconductive drum 20, on a surface of which an electrostatic latent image is to be formed, at a predetermined developing position NP (FIG. 3) and supplies the toner to the photoconductive drum 20. The developing roller 231 includes a first magnet 231A and a first sleeve 231B (FIG. 3). Note that, in this embodiment, the developing position NP includes a position where the photoconductive drum 20 and the developing roller 231 are closest to each other. The first magnet 231A is a cylindrical magnet including a plurality of magnetic poles along a circumferential direction and fixed to the housing 23H. The first sleeve 231B rotates in a first rotational direction (direction of an arrow D1 in FIGS. 2 and 3) around the first magnet 231A and carries developer containing the toner and magnetic carrier on a peripheral surface. In this embodiment, the first sleeve 231B is formed of a circular pipe member (base member) made of aluminum. Sandblasting (blasting) is applied to the peripheral surface of the circular pipe member of the first sleeve 231B and the circular pipe member includes a Ni plating layer applied on the peripheral surface thereof. A surface of the Ni plating layer of the first sleeve 231B has a predetermined surface roughness. In this embodiment, the surface roughness Rzjis of the first sleeve 231B is set in a range of 4.0 μm to 14.0 μm. The first sleeve 231B of the developing roller 231 is rotatably supported on the housing 23H.

The conveyor roller 232 is arranged to face the developing roller 231 at a predetermined facing position TP (FIG. 3) and supplies the developer to the developing roller 231. Note that, in this embodiment, the facing position TP includes a position where the conveyor roller 232 and the developing roller 231 are closest to each other. The conveyor roller 232 includes a second magnet 232A and a second sleeve 232B. The second magnet 232A includes a plurality of magnetic poles along a circumferential direction and is fixed to the housing 23H. The second sleeve 232B rotates in a second rotational direction (direction of an arrow D2 in FIGS. 2 and 3) around the second magnet 232A and carries the developer containing the toner and the carrier on a peripheral surface. The second sleeve 232B of the conveyor roller 232 is rotatably supported on the housing 23H.

Note that development biases in which an AC bias is superimposed on a DC bias are applied to the developing roller 231 and the conveyor roller 232 (FIG. 2). Further, as shown in FIG. 3, the first rotational direction D1 of the developing roller 231 and the second rotational direction D2 of the conveyor roller 232 are set to be opposite to each other at the facing position TP (counter directions).

The stirring screw 233 charges the toner by conveying two-component developer in a circulating manner while stirring this developer. The stirring screw 233 includes a first screw 233A and a second screw 233B. Note that although not shown in FIG. 2, the housing 23H includes an unillustrated first stirring portion in which the first screw 233A is arranged and an unillustrated second stirring portion in which the second screw 233B is arranged (see the developing device 23 of FIG. 1). The developer is conveyed in a circulating manner between the first and second screws 233A, 233B. The first screw 233A supplies the developer to the conveyor roller 232. The partition plate 234 is a plate-like member provided in the housing 23H. The partition plate 234 partitions between the first and second stirring portions along axial directions of the first and second screws 233A, 233B. Further, the toner supplied from the toner supplying unit 15 flows into the housing 23H from one axial end side of the second screw 233B and is stirred with the other developer.

The layer thickness regulating member 235 is a plate-like member made of nonmagnetic metal and arranged to face the peripheral surface of the conveyor roller 232. Note that a magnetic member may be fixed to an upstream side surface of the layer thickness regulating member 235 in another embodiment. The layer thickness regulating member 235 regulates a layer thickness of the developer supplied to the conveyor roller 232 from the first screw 233A of the stirring screw 233.

Further, as shown in FIG. 2, an axial center of the developing roller 231 is arranged below that of the photoconductive drum 20 and an axial center of the conveyor roller 232 is arranged further below that of the conveyor roller 231.

Further, with reference to FIG. 2, the developer composed of the toner and the carrier and conveyed in a circulating manner by the stirring screw 233 is supplied from the first screw 233A to the conveyor roller 232. Thereafter, this developer is supplied to the developing roller 231 after the layer thickness of the developer is regulated by the layer thickness regulating member 235. When part of the toner is supplied to the photoconductive drum 20 at the developing position NP (FIG. 3), the developer is collected from the developing roller 231 to the conveyor roller 232. Thereafter, the developer collected to the conveyor roller 232 flows again into the first stirring portion around the first screw 233A.

With reference to FIGS. 3 and 4, the first magnet 231A of the developing roller 231 has five magnetic poles along the circumferential direction in this embodiment. An N2 pole (second magnetic pole) is arranged downstream of the facing position TP between the developing roller 231 and the conveyor roller 232 in the first rotational direction (D1). Further, an S2 pole is arranged downstream of the N2 pole in the first rotational direction. The S2 pole functions as a carrying pole for carrying the developer received from the conveyor roller 232 toward the photoconductive drum 20. Further, an N3 pole functioning as a main pole for supplying the toner to the photoconductive drum 20 is arranged downstream of the S2 pole in the first rotational direction. The N3 pole is arranged near the developing position NP.

Further, the first magnet 231A has two magnetic poles (S3, N4) in a first region R downstream of the developing position NP in the first rotational direction and upstream of the facing position TP in the first rotational direction. The S3 pole is arranged downstream of the N3 pole in the first rotational direction. The N4 pole (first magnetic pole) is a magnetic pole arranged adjacent to and downstream of the S3 pole in the first rotational direction and upstream of the facing position TP in the first rotational direction and having a polarity different from the S3 pole. Further, the aforementioned N2 pole is arranged adjacent to and downstream of the N4 pole in the first rotational direction across the facing position TP.

Table 1 shows a magnet with angles and magnetic forces (peak values of radial components) of five magnetic poles illustrated as the first magnet 231A according to this embodiment. Magnetic flux density of the pole is hereinafter referred to as magnetic force of the pole. Note that the angle of each magnetic pole shown in Table 1 is shown along the first rotational direction with the facing position TP of FIG. 4 as a starting point (angle 0°). A straight line CL connecting the facing position TP and a rotation axis center of the developing roller 231 (straight line connecting the rotation axis center of the developing roller 231 and that of the conveyor roller 232) is shown as the above starting point in FIG. 4.

TABLE 1

| MAGNETIC POLE | MAGNETIC FORCE | ANGLE |
|---|---|---|
| N2 | 73 mT | 30° |
| S2 | 80 mT | 101° |
| N3 | 90 mT | 160° |
| S3 | 80 mT | 233° |
| N4 | 42 mT | 328° |

On the other hand, with reference to FIGS. 3 and 5, the second magnet 232A of the conveyor roller 232 has seven magnetic poles along the circumferential direction. An N5 pole (fourth magnetic pole) is arranged downstream of the facing position TP between the developing roller 231 and the conveyor roller 232 in the second rotational direction (D2). Further, S4, N6 and S5 poles are arranged downstream of the N5 pole in the second rotational direction. Furthermore, an S6 pole is arranged downstream of and at a distance from the S5 pole in the second rotational direction. The S5 pole functions as a peeling pole for peeling the developer received from the conveyor roller 232. The S6 pole functions as a draw-up pole for drawing up the developer from the first screw 233A. An N1 pole and an S1 pole (third magnetic pole) are arranged downstream of the S6 pole in the second rotational direction. As shown in FIG. 5, the aforementioned layer thickness regulating member 235 is arranged to face at a predetermined distance from the second sleeve 232B of the conveyor roller 232 between the N1 and S6 poles on a side upstream of the Si pole in the second rotational direction. In this embodiment, the S6 pole functions as a regulating pole. Thus, the layer thickness of the developer can be stably regulated before the developer is transferred from the conveyor roller 232 to the developing roller 231. Note that the S1 pole is arranged upstream of the facing position TP in the second rotational direction and the N5 pole is arranged adjacent to and downstream of the S1 pole in the second rotational direction across the facing position TP.

Table 2 shows angles and magnetic forces (peak values of radial components) of seven magnetic poles as an example of the second magnet 232A according to this embodiment. The angle of each magnetic pole shown in Table 2 is shown along the second rotational direction with the facing position TP of FIG. 5 as a starting point (angle 0°). Note that a straight line CL connecting the facing position TP and the rotation axis center of the conveyor roller 232 is shown as the above starting point in FIG. 5.

TABLE 2

| MAGNETIC POLE | MAGNETIC FORCE | ANGLE |
|---|---|---|
| S6 | 42 mT | 266° |
| N1 | 45 mT | 307° |
| S1 | 40 mT | 347° |

TABLE 2-continued

| MAGNETIC POLE | MAGNETIC FORCE | ANGLE |
|---|---|---|
| N5 | 78 mT | 30° |
| S4 | 53 mT | 83° |
| N6 | 46 mT | 136° |
| S5 | 40 mT | 188° |

Figure 7:
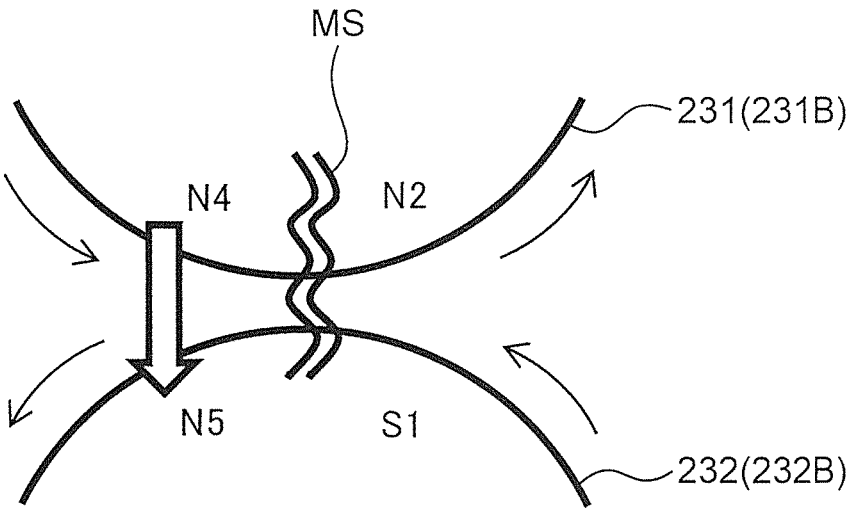
FIG. 7 is a diagram showing the periphery of a facing position between the developing roller and the conveyor roller of the developing device according to the first embodiment of the present disclosure.

Further, the arrangement and functions of four magnetic poles arranged around the facing position TP out of the first magnet 231A of the developing roller 231 and the second magnet 232A of the conveyor roller 232 are further described. FIG. 7 is a diagram showing the periphery of the facing position TP between the developing roller 231 and the conveyor roller 232 of the developing device 23 according to this embodiment. The N4, N2 poles of the first magnet 231A and the N5 pole of the second magnet 232A are magnetic poles having a polarity different from the S1 pole of the second magnet 232A. The developer having passed through the developing position NP is transferred from the developing roller 231 to the conveyor roller 232 by a magnetic field formed by the N4 and N5 poles. Further, the developer supplied from the first screw 233A of the stirring screw 233 to the conveyor roller 232 is transferred from the conveyor roller 232 to the developing roller 231 by a magnetic field formed by the S1 and N2 poles after being regulated by the layer thickness regulating member 235.

With reference to FIG. 6, the housing 23H includes a plurality of inner wall portions facing the developing roller 231 and the conveyor roller 232. Specifically, the housing 23H includes a first inner wall portion 23H1, a second inner wall portion 23H2, a third inner wall portion 23H3 and a fourth inner wall portion 23H4. The first inner wall portion 23H1 faces the S3 and N4 poles and extends along the peripheral surface of the first sleeve 231B of the developing roller 231 from the developing position NP to a position facing the N4 pole. The second inner wall portion 23H2 is connected to the first inner wall portion 23H1, faces the N5, S4 and N6 poles and extends along the peripheral surface of the second sleeve 232B of the conveyor roller 232. Similarly, the third inner wall portion 23H3 faces the S2 and N2 poles on a side opposite to the first inner wall portion 23H1 and extends along the peripheral surface of the first sleeve 231B of the developing roller 231 from the developing position NP to a position facing the N2 pole. The first sleeve 231B of the developing roller 231 is arranged to be partially exposed and face the photoconductive drum 20 between the first and third inner wall portions 23H1, 23H3. The fourth inner wall portion 23H4 is connected to the third inner wall portion 23H3, faces the S1 and N1 poles and extends along the peripheral surface of the second sleeve 232B of the conveyor roller 232. Note that, as shown in FIG. 6, substantially equal clearances H (conveyance path for the developer) are formed between the respective inner wall portions and the first sleeve 231B of the developing roller 231 and the second sleeve 232B of the conveyor roller 232. In this embodiment, heights of these clearances H are smaller than radii of the developing roller 231 and the developing roller 232 and set in a range of 0.5 mm to 2.0 mm. Note that a part of the housing 23H including the third and fourth inner wall portions 23H3, 23H4 is desirably detachable since the position of the layer thickness regulating member 235 needs to be adjusted.

As described above, development biases in which an AC bias is superimposed on a DC bias are applied to the developing roller 231 and the conveyor roller 232 during a developing operation of developing an electrostatic latent image on the photoconductive drum 20. Since this causes an oscillating electric field by the AC bias to be formed at the developing roller NP (development nip), fogging toner adhering to a background part on the photoconductive drum 20 can be collected. However, such an oscillating electric field attracts the toner also onto the first sleeve 231B of the developing roller 231. As a result, a toner layer (toner film) is easily formed on the surface of the first sleeve 231B.

Figure 8:
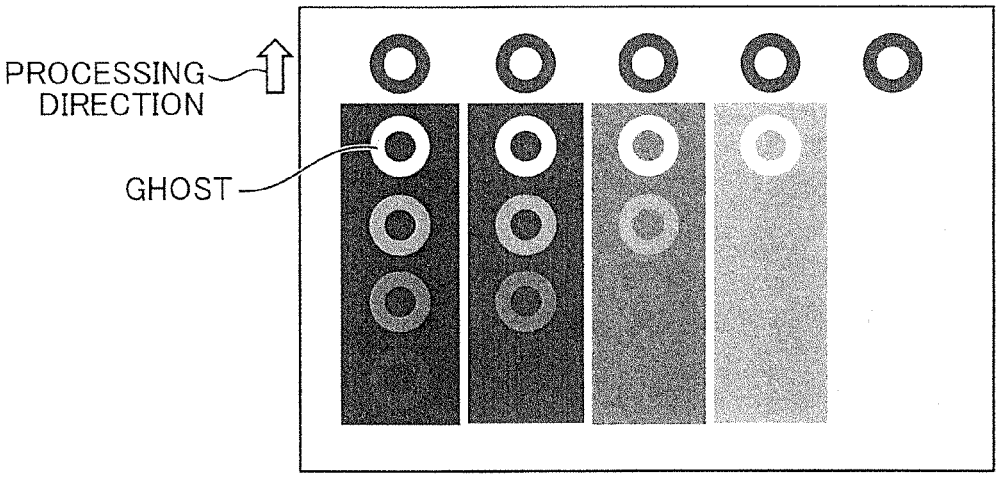
FIG. 8 is a diagram showing a state where ghosts are generated on a print.

A thickness of the toner layer formed on the first sleeve 231B of the developing roller 231 differs between an image part and a background part and this thickness difference remains as a history. FIG. 8 is a diagram showing ghost images generated on halftone images by such a toner consumption history. A history of ring-shaped images formed on an upstream side in a processing direction (sheet conveying direction) appears on succeeding halftone images. Such a history is based on a toner consumption amount difference in the above toner layer and due to a partial shift of a potential difference between the first sleeve 231B and the photoconductive drum 20 by electric charges of the remaining toner in the next halftone image.

In this embodiment, it is suitably suppressed that a thin toner layer is formed on the developing roller 231, which is one roller facing the photoconductive drum 20, and ghost images as described above are generated in the developing device 23 in which two magnetic rollers (developing roller 231, conveyor roller 232) are arranged. Specifically, the developing roller 231 of the developing device 23 has the aforementioned N4 pole and the conveyor roller 232 has the N5 pole to suppress such ghost images (FIG. 7).

By arranging the magnetic poles having the same polarity opposite to each other in a part where the developer is transferred from the developing roller 231 to the conveyor roller 23 in this way, a repulsive magnetic field is formed by the N4 and N5 poles. In this case, the developer conveyed from the N3 pole to the S3 pole and further to the N4 pole of the developing roller 231 cannot immediately move toward the conveyor roller 232 since the N5 and N4 poles facing each other have the same polarity as shown in FIG. 6. Further, the N2 pole having the same polarity as the N4 pole is arranged also on a downstream side in the first rotational direction of the developing roller 231. Thus, a magnetic shield MS is formed near the facing position TP (FIG. 7). The developer is partially retained on the developing roller 231 on the N4 pole by the repulsive magnetic field between the N4 and N5 poles. As a result, the retention portion TD of the developer is formed on the first sleeve 231B of the developing roller 231. In the retention portion TD, a magnetic brush of the developer is retained while slipping on the first sleeve 231B. Thus, even if the history of the toner consumed at the developing position NP remains in the toner layer on the first sleeve 231B, the history of the toner is eliminated (polished) by the magnetic brush of the developer retained in the retention portion TD. Thus, the developing device 23 having the generation of ghosts as described above suppressed is provided. Particularly, when a peak position of a magnetic pole is not present at the facing position TP between the developing roller 231 and the conveyor roller 232 as in this embodiment, a polishing force (scraping force) of the magnetic brush of the developer on the conveyor roller 232 is less likely to reach the surface of the first sleeve 231B. Even in such a case, the retention portion TD can be suitably formed by a repulsive force between the N4 and N5 poles provided in the developing roller 231 and the conveyor roller 232.

The developer that can be no longer held by the magnetic force of the N4 pole eventually flies from the retention portion TD. In this embodiment, a linear distance between the N4 and N5 poles is shorter than a circumferential distance between the N4 and N2 poles as described later. As a result, the developer having flown from the periphery of the N4 pole moves toward the N5 pole. Thereafter, the developer is separated from the conveyor roller 232 after being conveyed by the S4, N6 and S5 poles of the conveyor roller 232.

Further, in this embodiment, one developing roller is arranged to face the photoconductive drum 20 and develops an electrostatic latent image on the photoconductive drum 20. Thus, the electrostatic latent image needs to be stably developed at one developing position NP as compared to another developing device in which a plurality of developing rollers are adjacently arranged along the peripheral surface of the photoconductive drum 20. In other words, in the case of arranging the plurality of developing rollers along the rotational direction of the photoconductive drum 20 as described above, a density reduced part of a ghost image formed by the developing roller on an upstream side can be corrected by the developing roller on a downstream side. On the other hand, in this embodiment, if the history of the toner consumption formed on the first sleeve 231B of the developing roller 231 becomes a ghost image during the next rotation, it is difficult to correct. Thus, the next rotation of the history of the toner layer toward the developing position NP can be suitably suppressed by arranging the magnetic poles having the same polarity between two rollers as described above. As a result, the complication of the structure of the developing device 23 is suppressed and a cost increase of the developing device 23 is suppressed.

Further, in this embodiment, the first sleeve 231B is formed of the circular pipe member (base member) made of aluminum. Further, sandblasting (blasting) is applied to the peripheral surface of the circular pipe member of the first sleeve 231B and the circular pipe member includes the Ni plating layer applied on the peripheral surface thereof. Thus, the developer easily slips due to a surface property of the first sleeve 231B having blasting applied thereto and the retention portion TD of the developer is stably formed. Further, a charge amount of positively chargeable toner is easily reduced by the plating layer on the developing roller 231. As a result, a charge amount of the developer is reduced, the slip of the developer in the retention portion TD is promoted and an adhering force of the toner to the sleeve surface becomes smaller. Thus, the generation of ghost images is further suppressed. Note that the first sleeve 231B of the developing roller 231 may have a known groove shape instead of having blasting applied in another embodiment as described later. In this case, by performing outer periphery polishing such as centerless machining before or after groove formation or performing blasting after groove formation, the adhering force of the toner to the sleeve surface is reduced and the generation of ghost images is more suppressed as compared to the case where the first sleeve 231B has only a mere groove shape.

Further, in this embodiment, the N2 pole is arranged downstream of the N4 pole in the first rotational direction and the S1 pole is arranged upstream of the N5 pole in the second rotational direction. The developer can be stably supplied from the conveyor roller 232 to the developing roller 231 by a magnetic field formed by the S1 and N2 poles. The developer transferred from the conveyor roller 232 to the developing roller 231 is, thereafter, used to develop an electrostatic latent image on the photoconductive drum 20 at the developing position NP. Thus, it is desirable to transfer the developer without collapsing the magnetic brush of the developer by a magnetic field formed by the magnetic poles having different polarities. On the other hand, the developer transferred from the developing roller 231 to the conveyor roller 232 is the developer having passed through the developing position NP. Thus, the developer may be transferred with the magnetic brush of the developer collapsed by a repulsive magnetic field formed by the magnetic poles having the same polarity. Therefore, in this embodiment, the retention portion TD of the developer can be formed in a region where the developer is transferred from the developing roller 231 to the conveyor roller 232.

As just described, in this embodiment, developer transfer regions between the developing roller 231 and the conveyor roller 232 are stably formed in different directions at positions across the facing position TP. Particularly, the developer is transferred from the conveyor roller 232 to the developing roller 231 by the magnetic poles having different polarities and the developer is transferred from the developing roller 231 to the conveyor roller 232 by the magnetic poles having the same polarity. Note that, in this embodiment, a gap between the developing roller 231 and the photoconductive drum 20 (developing position NP) is set to be larger than 0.25 mm and not larger than 0.40 mm as an example. On the other hand, a gap between the developing roller 231 and the conveyor roller 232 (facing position TP) is set to be not smaller than 0.18 mm and not larger than 0.25 mm. In other words, the gap between the developing roller 231 and the conveyor roller 232 is set to be narrower than the gap between the developing roller 231 and the photoconductive drum 20. The developer is transferred between the developing roller 231 and the conveyor roller 232 across the facing position TP set to be narrow in this way. Note that the peak position of none of the magnetic poles is facing the facing position TP as described above. Thus, even if the gap of the facing position TP is set to be narrow as described above, it is suppressed that the developer present at the facing position TP is fixed. Further, since two magnetic brushes of the developer for transfer are formed across the facing position TP in the circumferential direction, even if the toner scatters at the facing position TP, this toner can be confined.

Further, with reference to FIG. 6, the axial center of the developing roller 231 is arranged below that of the photoconductive drum 20 and the axial center of the conveyor roller 232 is arranged below that of the developing roller 231 in this embodiment. Thus, coupled with a gravitational action, the developer overflowing from the retention portion TD of the developer is stably transferred toward the conveyor roller 232. At this time, since the first and second inner wall portions 23H1 and 23H2 are connected to each other while being formed along the peripheral surfaces of the developing roller 231 and the conveyor roller 232, the developer can be smoothly transferred from the developing roller 231 to the developing roller 232. Further, since the retention portion TD of the developer is arranged in contact with or in proximity to the first inner wall portion 23H1, the scattering of the toner in the developer around the retention portion TD is suppressed. Further, the scattering of the toner in the developer toward the developing position NP is suppressed. Furthermore, since the conveyance path of the developer is limited, a movement range of the developer is restricted and the retention portion TD of the developer can be stably formed. Similarly, also in the developer transfer region from the conveyor roller 232 to the developing roller 231, the developer can be smoothly transferred from the conveyor roller 232 to the developing roller 231 by the third and fourth inner wall portions 23H3 and 23H4.

Here, a problem in an assumed case where the 51 pole is not arranged in FIG. 7 is further described. In this case, only three N poles having the same polarity are arranged near the closest position of the two rollers. In such a configuration, since a repulsive magnetic field is concentrated, a magnetic field formed among the magnetic poles is largely affected if the magnetic force or position of one magnetic pole out of three N poles even slightly changes. As a result, a flying state of the developer easily changes and, further, a phenomenon in which a large amount of the developer passes through the facing position TP easily occurs. Further, since the three N poles are repulsive to each other, it is difficult to set the angles of the magnetic poles of the first and second magnets 231A, 232A. Unillustrated fixing shafts are arranged on axial end parts of the first and second magnets 231A, 232A. End parts of these fixing shafts have a D cut shape and positioning members to be fitted to the magnets having a D cut shape are mounted on the housing 23H. As a result, angular positions of the magnetic poles of the first and second magnets 231A, 232A in the developing device 23 are determined. However, if the S1 pole of this embodiment is not provided as described above, the repulsive magnetic field may vary within ranges of a magnetic force tolerance and a magnetic pole position tolerance depending on conveyance conditions of the developer since the three N poles are repulsive to each other. As a result, an unstable magnetic field is generated within a range of a fitting play (clearance) of the D cut shapes. This variation of the magnetic field appears as image unevenness at the developing position NP during an image forming operation. Further, since the position of the S6 pole of the second magnet 232A also varies in this case, the amount of the developer supplied from the first screw 233A (FIG. 2) to the conveyor roller 232 also easily varies. As just described, in a configuration in which only the magnetic poles having the same polarity are arranged at the facing position TP, the transfer of the developer among the stirring screw 233, the conveyor roller 232 and the developing roller 231 tends to be unstable.

On the other hand, since the S1 and N2 poles having different polarities attract each other in this embodiment, magnetic lines of force are formed between the both. As a result, it is suppressed that the N2 and S1 poles largely affect the repulsive magnetic field formed between the N4 and N5 poles, and the magnetic field around the facing position TP is easily stabilized. As just described, in this embodiment, the S1 pole is arranged on the side of the conveyor roller 232 in the developer transfer region from the conveyor roller 232 to the developing roller 231. The S1 pole is a magnetic pole having a polarity different from the N4, N2 and N5 poles similarly having a developer transfer function. To prevent the developer having no sufficient toner density after passing through the developing position NP from moving from the N4 pole toward the N2 pole, the S1 pole out of the four magnetic poles is preferably located on the side of the second magnet 232A rather than on the side of the first magnet 231A (FIG. 7).

Note that as the amount of the developer retained on the N4 pole increases, an effect of cleaning the toner layer on the first sleeve 231B becomes higher. Thus, the repulsive magnetic field between the N4 and N5 poles is desirably stronger for the cleaning effect. To make the retention portion TD easily grow, it is desirable to arrange the S3 pole upstream of the N4 pole in the first rotational direction at a position near the N4 pole in addition to the repulsive magnetic field between the N4 and N5 poles. In this case, magnetic lines of force extending from the S3 pole to the N4 pole become stronger and the retention portion TP is formed to be larger. Note that a degree of influence of this S3 pole on the retention portion TD can be expressed by a horizontal component (also called a tangential component) of the magnetic force between the S3 and N4 poles. The stronger the horizontal component of the magnetic force, the larger the retention portion TD formed. Further, as a peak position of the horizontal component of the magnetic force becomes closer to the N4 pole, the retention portion TD increases and a toner layer cleaning property is improved. In other words, the arrangement of the magnetic poles of the first magnet 231A is desirably set such that the peak position of the horizontal component is closer to the N4 pole than a point where a vertical component (also called a radial component) of the magnetic force between the S3 and N4 poles is 0.

Figure 9:
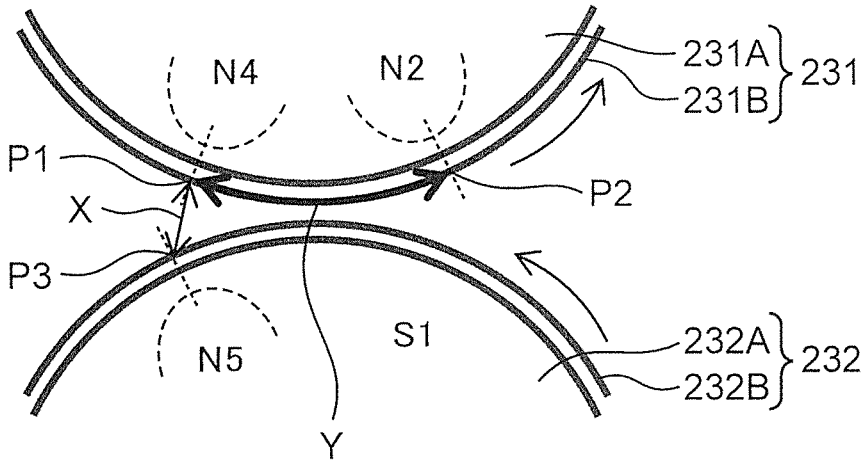
FIG. 9 is a diagram showing the periphery of the facing position between the developing roller and the conveyor roller of the developing device according to the first embodiment of the present disclosure.

FIG. 9 is a diagram of the periphery of the facing position TP between the developing roller 231 and the conveyor roller 232. In this embodiment, a relationship of the following Equation 1 is desirably satisfied if a position on the circumference of the first sleeve 231B facing the peak position of the N4 pole is a first outer peripheral position P1, a position on the circumference of the first sleeve 231B facing the peak position of the N2 pole is a second outer peripheral position P2, a position on the circumference of the second sleeve 232B facing the peak position of the N5 pole is a third outer peripheral position P3, a linear distance between the first and third outer peripheral positions P1 and P3 is X (mm), a distance on the peripheral surface of the first sleeve 231B between the first and second outer peripheral positions P1 and P2 is Y (mm), a peak magnetic force of the N4 pole is A (mT), a peak magnetic force of the N2 pole is B (mT), a peak magnetic force of the N5 pole is C (mT) and a conveyance amount of the developer on the conveyor roller 232 regulated by the layer thickness regulating member 235 (FIG. 6) is M (g/m$^2$) in radial components of magnetic forces of the first and second magnets 231A, 232A when viewed in a cross-section perpendicular to an axial direction in the rotation of the developing roller 231 and the conveyor roller 232 (FIG. 9).

$$3.48 \leq \beta/\alpha \leq 6.28,\ (\alpha=(A+C)/X,\ \beta=(A+B)/Y) \quad (1)$$

The developer is stably transferred from the developing roller 231 to the conveyor roller 232 even if the N4 and N5 are magnetic poles having the same polarity by satisfying $3.48 \leq \beta/\alpha$ in the Equation. Further, an increase of a drive torque of the developing roller 231 or the developing roller 232 due to an excessive increase of the amount of the developer of the retention portion TD is suppressed and the occurrence of rotation unevenness of the developing roller 231 or the conveyor roller 232 is suppressed by satisfying $\beta/\alpha \leq 6.28$.

Next, the first embodiment of the present disclosure is further described on the basis of examples. Note that the present disclosure is not limited to the following examples. Experiments 1 and 2 described later were conducted under the following experimental conditions.

<Experimental Conditions>

Print speed: 55 sheets/min

Photoconductive drum 20: amorphous silicon photoconductor (a-Si) having a diameter φ of 30 mm, surface potentials Vo (blank part, background part)=+270 V and VL (image part)=+20V and a circumferential speed=300 mm/sec Gap between layer thickness regulating member 235 and second sleeve 232B: 200 to 600 μm Developer conveyance amount (after layer thickness regulation) on conveyor roller 232, developing roller 231: 100 to 300 g/m$^2$ Carrier: ferrite resin coated carrier having a volume average particle diameter of 35 μm and a magnetic force of 80 emu/g Toner: a volume average particle diameter of 6.8 μm, a toner density of 7%, positively charging property Conditions of the developing roller 231 are as follows.

Developing roller 231: a diameter φ of 20 mm

Circumferential speed ratio of the developing roller 231 to photoconductive drum 20: 1.8 (same direction at the facing position, with direction)

Gap between developing roller 231 and photoconductive drum 20: 300 μm

Development bias: DC bias=170 V, AC bias=Vpp 1.4 kV, a frequency f of 3.7 kHz, a duty ratio of 50%, rectangular wave (note that the conveyor roller 232 and the layer thickness regulating member 235 also have the same potential). Note that Vpp is variable in Experiment 1.

Surface conditions of first sleeve 231B:

(Condition 1) Sandblasting (Rzjis=7 μm), Ni plating (Condition 2) Sandblasting (Rzjis=7 μm), no plating Further, a magnetic pole distribution of the developing roller 231 used in the experiments is as shown in the previous Table 1. Note that magnetic forces of the developing roller 231 and the conveyor roller 232 were measured using a GAUSS METER Model GX-100 produced by Nihon Denji Sokki Co., Ltd.

Further, conditions of the conveyor roller 232 used in the experiments are as follows.

Conveyor roller 232: a diameter φ of 20 mm

Surface conditions of second sleeve 232B: knurled V grooves (groove depth of 80 μm, groove width of 0.2 mm, the number of grooves of 120)

Circumferential speed ratio of conveyor roller 232 to developing roller 231: 1.4 (opposite directions at the facing position, counter directions)

Gap between conveyor roller 232 and developing roller 231: 250 μm

Further, a magnetic pole distribution of the conveyor roller 232 used in the experiments is as shown in the previous Table 2.

Figure 10:
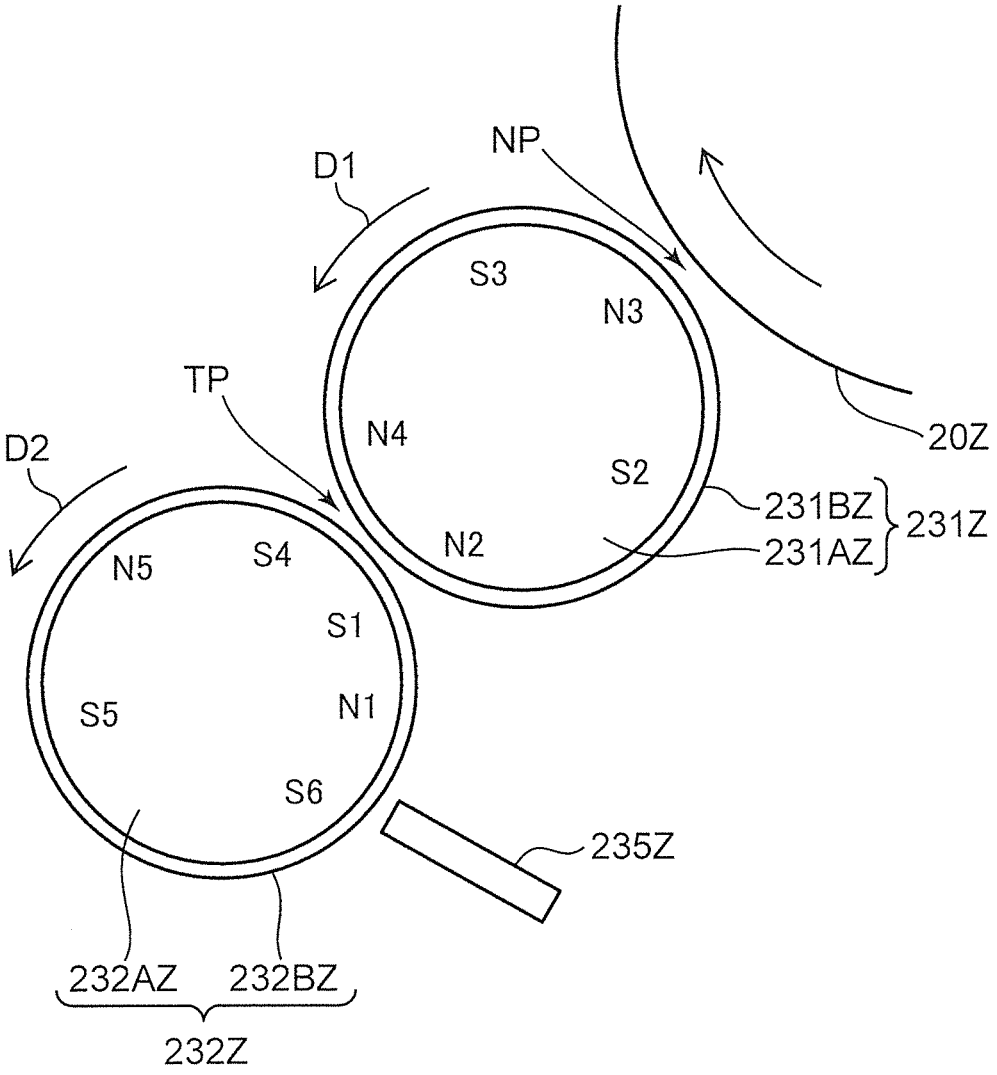
FIG. 10 is a schematic sectional view showing the arrangements of magnetic poles of a developing roller and a conveyor roller of a developing device according to a comparative example to be compared with examples of the first embodiment of the present disclosure.

Examples having no Ni plating applied thereto in the surface conditions of the first sleeve 231B in the above experimental conditions were respectively set as Example 1-1 and Example 1-2. Further, a developing device of Comparative Example 1-1 to be compared with Example 1-1 and Example 1-2 is shown in FIG. 10. This developing device includes a developing roller 231Z arranged to face a photoconductive drum 20Z and a conveyor roller 232Z arranged to face the developing roller 231Z. Note that the structures of a housing and the like are as in Example 1-1 and Example 1-2 (FIG. 6). Particularly, in Comparative Example 1-1, the developer is transferred from the developing roller 231Z to the conveyor roller 232Z by N4 and S4 poles having different polarities at a facing position where the developing roller 231Z and the conveyor roller 232Z are facing each other. Note that a magnetic force (radial component) of each magnetic pole of a first magnet 231AZ of the developing roller 231Z of Comparative Example 1-1 is shown in Table 3 and a magnetic force (radial component) of each magnetic pole of a second magnet 232AZ of the conveyor roller 232Z is shown in Table 4.

TABLE 3

| MAGNETIC POLE | MAGNETIC FORCE |
|---|---|
| N2 | 73 mT |
| S2 | 80 mT |
| N3 | 90 mT |
| S3 | 80 mT |
| N4 | 42 mT |

TABLE 4

| MAGNETIC POLE | MAGNETIC FORCE |
|---|---|
| S6 | 42 mT |
| N1 | 68 mT |
| S1 | 35 mT |
| S4 | 48 mT |
| N5 | 72 mT |
| S5 | 35 mT |

Under the above conditions, a ghost confirmation pattern image shown in FIG. 8 was printed and an evaluation was made based on the number of generated ghosts. In the ghost confirmation pattern, five patterns (doughnut-shaped original images) are juxtaposed in a horizontal direction and halftone images are formed behind them. Five patterns of the halftone images respectively differed in density and how many ghosts were generated in each halftone part was evaluated. The ghosts are counted up to the fourth turn from the original image and a maximum of 20 ghosts are generated per print. Further, the above evaluation was made with the development AC bias Vpp changed in five levels of 1.0 kV, 1.2 kV, 1.4 kV, 1.6 kV and 1.8 kV (a total maximum of 100 ghosts were generated). A ghost evaluation result in Example 1-1, Example 1-2 and Comparative Examples 1-1 is shown in Table 5.

TABLE 5

| | COMPARATIVE EXAMPLE 1-1 | EXAMPLE 1-1 | EXAMPLE 1-2 |
|---|---|---|---|
| Ni PLATING | NO | NO | YES |
| GHOST | 35 | 24 | 14 |

As shown in Table 5, in Example 1-1, Example 1-2 conducted as examples of the first embodiment of the present disclosure, the number of the generated ghosts was improved as compared to Comparative Example 1-1. Further, the ghosts were largely improved by applying plating to the first sleeve 231B as in Example 1-2. For the positively chargeable toner, toner chargeability is reduced and the retention portion TD is stably formed by applying Ni plating to the first sleeve 231B. Note that if the surface of aluminum or SUS is exposed on the surface of the first sleeve 231B, a passivation layer is formed on the surface in either case. This passivation layer is negatively chargeable and has a property of increasing the charge amount of the positively chargeable toner. If the toner adhering onto the first sleeve 231B of the developing roller 231 is charged by the above passivation layer, an image force of the toner is increased and the toner is less likely to be separated from the surface of the sleeve 231B. In contrast, the Ni plating is positively chargeable and tends to reduce the charge amount of the toner. As a result, the cleaning property at the N4 pole is increased due to the slipperiness of the plating layer and the toner is less charged, wherefore ghosts are more eliminated.

Note that, as a result of a similar evaluation in a Rzjis range of not smaller than 4 μm and not larger than 14 μm, it was found that results similar to the above were obtained for Conditions 1 and 2 of the first sleeve 231B. Further, it was confirmed that there was no difference in Rzjis of the first sleeve 231B after and before plating if a film thickness of the Ni plating is in a range of not smaller than 3 μm and not larger than 5 μm.

<Experiment 2>

Next, an evaluation was made on the transfer of the developer between the N4 and N5 poles having the same polarity. Tables 6 to 10 show each experimental condition and an evaluation result with the conveyance amount of the developer regulated by the layer thickness regulating member 235, the diameters of the developing roller 231 and the developing roller 232, magnetic forces (peak magnetic forces of radial components), the magnetic pole arrangement (angles) and the gap (DMS) between the developing roller 231 and the conveyor roller 232 changed. Note that the angles of the N2, N4 and N5 poles in Tables 6 to 10 indicate a peak position of each magnetic pole with the straight line CL connecting the rotation axis center of the developing roller 231 and that of the conveyor roller 232 as a starting point. At this time, the angle of the N2 pole is measured on a side downstream of the straight line CL in the first rotational direction, the angle of the N4 pole is measured on a side upstream of the straight line CL in the first rotational direction and the angle of the N5 pole is measured on a side downstream of the straight line CL in the second rotational direction. Further, the peak position of each magnetic pole corresponds to a center position between two points indicating 80% magnetic force of a maximum magnetic force (peak magnetic force).

TABLE 6

| | DEVELOPER | | | MAGNETIC FORCE | | | | ANGLE | | |
|---|---|---|---|---|---|---|---|---|---|---|
| NO. | CONVEYANCE AMOUNT g/m² | DEVELOPING ROLLER φ (mm) | CONVEYOR ROLLER φ (mm) | S1 POLE mT | N2 POLE mT | N4 POLE mT | N5 POLE mT | N2 POLE ° | N4 POLE ° | N5 POLE ° |
| 1 | 100 | 20 | 20 | 65 | 67 | 46 | 64 | 30 | 28 | 31 |
| 2 | 100 | 20 | 20 | 65 | 64 | 43 | 64 | 22 | 29 | 31 |
| 3 | 100 | 20 | 20 | 65 | 70 | 44 | 64 | 41 | 27 | 31 |
| 4 | 100 | 20 | 20 | 65 | 66 | 44 | 84 | 30 | 23 | 31 |
| 5 | 100 | 20 | 20 | 65 | 68 | 45 | 64 | 30 | 38 | 31 |
| 6 | 100 | 20 | 20 | 56 | 67 | 46 | 64 | 30 | 28 | 44 |
| 7 | 100 | 20 | 20 | 41 | 67 | 46 | 64 | 30 | 28 | 46 |
| 8 | 100 | 20 | 20 | 65 | 67 | 46 | 64 | 30 | 28 | 31 |
| 9 | 100 | 20 | 20 | 65 | 64 | 43 | 64 | 22 | 29 | 31 |
| 10 | 100 | 20 | 20 | 65 | 70 | 44 | 64 | 41 | 27 | 31 |
| 11 | 100 | 20 | 20 | 65 | 66 | 44 | 64 | 30 | 23 | 31 |
| 12 | 100 | 20 | 20 | 65 | 68 | 45 | 64 | 30 | 38 | 31 |
| 13 | 100 | 20 | 20 | 56 | 67 | 46 | 64 | 30 | 28 | 44 |
| 14 | 100 | 20 | 20 | 41 | 67 | 46 | 64 | 30 | 28 | 46 |
| 15 | 100 | 20 | 20 | 65 | 67 | 46 | 64 | 30 | 28 | 31 |
| 16 | 100 | 20 | 20 | 65 | 64 | 43 | 64 | 22 | 29 | 31 |
| 17 | 100 | 20 | 20 | 65 | 70 | 44 | 64 | 41 | 27 | 31 |
| 18 | 100 | 20 | 20 | 65 | 66 | 44 | 64 | 30 | 23 | 31 |
| 19 | 100 | 20 | 20 | 65 | 68 | 45 | 64 | 30 | 38 | 31 |
| 20 | 100 | 20 | 20 | 56 | 67 | 46 | 64 | 30 | 28 | 44 |
| 21 | 100 | 20 | 20 | 41 | 67 | 46 | 64 | 30 | 28 | 46 |

| | | | | | | | EVALUATION RESULT | |
|---|---|---|---|---|---|---|---|---|
| NO. | DMS mm | X mm | Y mm | α (N4 + N5)/X | β (N2 + N4)/Y | α/β | DRIVE UNEVENNESS | TRANSFER FAILURE |
| 1 | 0.25 | 2.9 | 10.1 | 38.1 | 11.2 | 3.4 | NO | NO |
| 2 | 0.25 | 2.9 | 8.9 | 36.3 | 12.0 | 3.0 | NO | NO |
| 3 | 0.25 | 2.8 | 11.9 | 38.1 | 9.6 | 4.0 | NO | NO |
| 4 | 0.25 | 2.8 | 9.3 | 39.0 | 11.9 | 3.3 | NO | NO |
| 5 | 0.25 | 3.9 | 11.9 | 27.7 | 9.5 | 2.9 | NO | YES |
| 6 | 0.25 | 4.8 | 10.1 | 23.0 | 11.2 | 2.1 | NO | YES |
| 7 | 0.25 | 5.1 | 10.1 | 21.5 | 11.2 | 1.9 | NO | YES |
| 8 | 0.5 | 3.1 | 10.1 | 35.1 | 11.2 | 3.1 | NO | NO |
| 9 | 0.5 | 3.2 | 8.9 | 33.5 | 12.0 | 2.8 | NO | NO |
| 10 | 0.5 | 3.1 | 11.9 | 35.1 | 9.6 | 3.7 | NO | NO |
| 11 | 0.5 | 3.0 | 9.3 | 36.1 | 11.9 | 3.0 | NO | NO |
| 12 | 0.5 | 4.2 | 11.9 | 26.1 | 9.5 | 2.7 | NO | YES |
| 13 | 0.5 | 5.0 | 10.1 | 21.9 | 11.2 | 2.0 | NO | YES |
| 14 | 0.5 | 5.3 | 10.1 | 20.6 | 11.2 | 1.8 | NO | YES |
| 15 | 1 | 3.6 | 10.1 | 30.3 | 11.2 | 2.7 | NO | NO |
| 16 | 1 | 3.7 | 8.9 | 29.0 | 12.0 | 2.4 | NO | NO |
| 17 | 1 | 3.6 | 11.9 | 30.2 | 9.6 | 3.1 | NO | NO |
| 18 | 1 | 3.5 | 9.3 | 31.3 | 11.9 | 2.6 | NO | YES |
| 19 | 1 | 4.7 | 11.9 | 23.4 | 9.5 | 2.5 | NO | YES |
| 20 | 1 | 5.5 | 10.1 | 20.1 | 11.2 | 1.8 | NO | YES |
| 21 | 1 | 5.8 | 10.1 | 19.0 | 11.2 | 1.7 | NO | YES |

TABLE 7

| NO. | DEVELOPER CONVEYANCE AMOUNT g/m$^2$ | DEVELOPING ROLLER φ (mm) | CONVEYOR ROLLER φ (mm) | MAGNETIC FORCE S1 POLE mT | N2 POLE mT | N4 POLE mT | N5 POLE mT | ANGLE N2 POLE ° | N4 POLE ° | N5 POLE ° |
|---|---|---|---|---|---|---|---|---|---|---|
| 22 | 100 | 16 | 16 | 30 | 70 | 43 | 55 | 29 | 27 | 35 |
| 23 | 100 | 16 | 16 | 30 | 70 | 43 | 55 | 29 | 27 | 35 |
| 24 | 100 | 16 | 16 | 30 | 70 | 43 | 55 | 29 | 27 | 35 |
| 25 | 100 | 16 | 16 | 30 | 70 | 43 | 55 | 29 | 27 | 35 |
| 26 | 100 | 20 | 20 | 30 | 40 | 43 | 83 | 35 | 22 | 29 |
| 27 | 100 | 20 | 20 | 34 | 45 | 42 | 77 | 30 | 28 | 25 |
| 28 | 100 | 20 | 20 | 30 | 40 | 43 | 83 | 35 | 22 | 29 |
| 29 | 100 | 20 | 20 | 34 | 45 | 42 | 65 | 30 | 28 | 25 |
| 30 | 100 | 20 | 20 | 30 | 40 | 43 | 83 | 35 | 22 | 29 |
| 31 | 100 | 20 | 20 | 34 | 45 | 42 | 77 | 30 | 28 | 31 |
| 32 | 100 | 20 | 20 | 30 | 40 | 43 | 83 | 35 | 22 | 29 |
| 33 | 150 | 20 | 20 | 65 | 70 | 44 | 64 | 41 | 27 | 31 |
| 34 | 150 | 20 | 20 | 65 | 67 | 46 | 64 | 30 | 28 | 31 |
| 35 | 150 | 20 | 20 | 65 | 66 | 44 | 64 | 30 | 23 | 31 |
| 36 | 150 | 20 | 20 | 65 | 64 | 43 | 64 | 22 | 29 | 31 |
| 37 | 150 | 20 | 20 | 65 | 68 | 45 | 64 | 30 | 38 | 31 |
| 38 | 150 | 20 | 20 | 65 | 68 | 45 | 64 | 30 | 38 | 31 |
| 39 | 150 | 20 | 20 | 65 | 66 | 44 | 64 | 30 | 23 | 31 |
| 40 | 150 | 20 | 20 | 56 | 67 | 46 | 64 | 30 | 28 | 44 |
| 41 | 150 | 20 | 20 | 41 | 67 | 46 | 64 | 30 | 28 | 46 |

| NO. | DMS mm | X mm | Y mm | α (N4 + N5)/X | β (N2 + N4)/Y | α/β | EVALUATION RESULT DRIVE UNEVENNESS | TRANSFER FAILURE |
|---|---|---|---|---|---|---|---|---|
| 22 | 0.25 | 2.7 | 7.8 | 35.8 | 14.5 | 2.5 | NO | YES |
| 23 | 0.5 | 3.0 | 7.8 | 32.9 | 14.5 | 2.3 | NO | YES |
| 24 | 0.75 | 3.2 | 7.8 | 30.5 | 14.5 | 2.1 | NO | YES |
| 25 | 1 | 3.5 | 7.8 | 28.4 | 14.5 | 2.0 | NO | YES |
| 26 | 0.25 | 2.5 | 9.9 | 50.6 | 8.3 | 6.1 | YES | NO |
| 27 | 0.25 | 2.4 | 10.1 | 49.5 | 8.6 | 5.8 | NO | NO |
| 28 | 0.5 | 2.7 | 9.9 | 46.4 | 8.3 | 5.6 | NO | NO |
| 29 | 0.25 | 2.4 | 10.1 | 44.5 | 8.6 | 5.2 | NO | NO |
| 30 | 0.75 | 2.9 | 9.9 | 42.8 | 8.3 | 5.1 | NO | NO |
| 31 | 0.25 | 2.9 | 10.1 | 41.2 | 8.6 | 4.8 | NO | NO |
| 32 | 1 | 3.2 | 9.9 | 39.6 | 8.3 | 4.8 | NO | NO |
| 33 | 0.25 | 2.8 | 11.9 | 38.1 | 9.6 | 4.0 | NO | NO |
| 34 | 0.25 | 2.9 | 10.1 | 38.1 | 11.2 | 3.4 | NO | NO |
| 35 | 0.25 | 2.8 | 9.3 | 39.0 | 11.9 | 3.3 | NO | NO |
| 36 | 0.25 | 2.9 | 8.9 | 36.3 | 12.0 | 3.0 | NO | NO |
| 37 | 0.25 | 3.9 | 11.9 | 27.7 | 9.5 | 2.9 | NO | NO |
| 38 | 0.5 | 4.2 | 11.9 | 26.1 | 9.5 | 2.7 | NO | YES |
| 39 | 1 | 3.5 | 9.3 | 31.3 | 11.9 | 2.6 | NO | YES |
| 40 | 0.25 | 4.8 | 10.1 | 23.0 | 11.2 | 2.1 | NO | YES |
| 41 | 0.25 | 5.1 | 10.1 | 21.5 | 11.2 | 1.9 | NO | YES |

TABLE 8

| NO. | DEVELOPER CONVEYANCE AMOUNT g/m$^2$ | DEVELOPING ROLLER φ (mm) | CONVEYOR ROLLER φ (mm) | MAGNETIC FORCE S1 POLE mT | N2 POLE mT | N4 POLE mT | N5 POLE mT | ANGLE N2 POLE ° | N4 POLE ° | N5 POLE ° |
|---|---|---|---|---|---|---|---|---|---|---|
| 42 | 150 | 20 | 20 | 30 | 40 | 43 | 83 | 35 | 22 | 29 |
| 43 | 150 | 20 | 20 | 34 | 45 | 42 | 77 | 30 | 28 | 25 |
| 44 | 150 | 20 | 20 | 30 | 40 | 43 | 83 | 35 | 22 | 29 |
| 45 | 150 | 20 | 20 | 34 | 45 | 42 | 65 | 30 | 28 | 25 |
| 46 | 150 | 20 | 20 | 30 | 40 | 43 | 83 | 35 | 22 | 29 |
| 47 | 150 | 20 | 20 | 34 | 45 | 42 | 77 | 30 | 28 | 31 |
| 48 | 150 | 20 | 20 | 30 | 40 | 43 | 83 | 35 | 22 | 29 |
| 49 | 200 | 20 | 20 | 65 | 70 | 44 | 64 | 41 | 27 | 31 |
| 50 | 200 | 20 | 20 | 65 | 67 | 46 | 64 | 30 | 28 | 31 |
| 51 | 200 | 20 | 20 | 65 | 66 | 44 | 64 | 30 | 23 | 31 |
| 52 | 200 | 20 | 20 | 65 | 64 | 43 | 64 | 22 | 29 | 31 |
| 53 | 200 | 20 | 20 | 65 | 68 | 45 | 64 | 30 | 38 | 31 |
| 54 | 200 | 20 | 20 | 65 | 68 | 45 | 64 | 30 | 38 | 31 |
| 55 | 200 | 20 | 20 | 65 | 66 | 44 | 64 | 30 | 23 | 31 |
| 56 | 200 | 20 | 20 | 56 | 67 | 46 | 64 | 30 | 28 | 44 |
| 57 | 200 | 20 | 20 | 41 | 67 | 46 | 64 | 30 | 28 | 46 |

TABLE 8-continued

| | | | | | | | | | | |
|---|---|---|---|---|---|---|---|---|---|---|
| 58 | 200 | 20 | 20 | 30 | 40 | 43 | 83 | 35 | 22 | 29 |
| 59 | 200 | 20 | 20 | 34 | 45 | 42 | 77 | 30 | 28 | 25 |
| 60 | 200 | 20 | 20 | 30 | 40 | 43 | 83 | 35 | 22 | 29 |
| 61 | 200 | 20 | 20 | 34 | 45 | 42 | 65 | 30 | 28 | 25 |
| 62 | 200 | 20 | 20 | 30 | 40 | 43 | 83 | 35 | 22 | 29 |
| 63 | 200 | 20 | 20 | 34 | 45 | 42 | 77 | 30 | 28 | 31 |
| 64 | 200 | 20 | 20 | 30 | 40 | 43 | 83 | 35 | 22 | 29 |

| | | | | | | | EVALUATION RESULT | |
|---|---|---|---|---|---|---|---|---|
| NO. | DMS mm | X mm | Y mm | α (N4 + N5)/X | β (N2 + N4)/Y | α/β | DRIVE UNEVENNESS | TRANSFER FAILURE |
| 42 | 0.25 | 2.5 | 9.9 | 50.6 | 8.3 | 6.1 | YES | NO |
| 43 | 0.25 | 2.4 | 10.1 | 49.5 | 8.6 | 5.8 | YES | NO |
| 44 | 0.5 | 2.7 | 9.9 | 46.4 | 8.3 | 5.6 | NO | NO |
| 45 | 0.25 | 2.4 | 10.1 | 44.5 | 8.6 | 5.2 | NO | NO |
| 46 | 0.75 | 2.9 | 9.9 | 42.8 | 8.3 | 5.1 | NO | NO |
| 47 | 0.25 | 2.9 | 10.1 | 41.2 | 8.6 | 4.8 | NO | NO |
| 48 | 1 | 3.2 | 9.9 | 39.6 | 8.3 | 4.8 | NO | NO |
| 49 | 0.25 | 2.8 | 11.9 | 38.1 | 9.6 | 4.0 | NO | NO |
| 50 | 0.25 | 2.9 | 10.1 | 38.1 | 11.2 | 3.4 | NO | NO |
| 51 | 0.25 | 2.8 | 9.3 | 39.0 | 11.9 | 3.3 | NO | NO |
| 52 | 0.25 | 2.9 | 8.9 | 36.3 | 12.0 | 3.0 | NO | NO |
| 53 | 0.25 | 3.9 | 11.9 | 27.7 | 9.5 | 2.9 | NO | NO |
| 54 | 0.5 | 4.2 | 11.9 | 26.1 | 9.5 | 2.7 | NO | NO |
| 55 | 1 | 3.5 | 9.3 | 31.3 | 11.9 | 2.6 | NO | NO |
| 56 | 0.25 | 4.8 | 10.1 | 23.0 | 11.2 | 2.1 | NO | YES |
| 57 | 0.25 | 5.1 | 10.1 | 21.5 | 11.2 | 1.9 | NO | YES |
| 58 | 0.25 | 2.5 | 9.9 | 50.6 | 8.3 | 6.1 | YES | NO |
| 59 | 0.25 | 2.4 | 10.1 | 49.5 | 8.6 | 5.8 | YES | NO |
| 60 | 0.5 | 2.7 | 9.9 | 46.4 | 8.3 | 5.6 | YES | NO |
| 61 | 0.25 | 2.4 | 10.1 | 44.5 | 8.6 | 5.2 | NO | NO |
| 62 | 0.75 | 2.9 | 9.9 | 42.8 | 8.3 | 5.1 | NO | NO |
| 63 | 0.25 | 2.9 | 10.1 | 41.2 | 8.6 | 4.8 | NO | NO |
| 64 | 1 | 3.2 | 9.9 | 39.6 | 8.3 | 4.8 | NO | NO |

TABLE 9

| | DEVELOPER | | | MAGNETIC FORCE | | | | ANGLE | | |
|---|---|---|---|---|---|---|---|---|---|---|
| NO. | CONVEYANCE ANOUNT g/m$^2$ | DEVELOPING ROLLER φ (mm) | CONVEYOR ROLLER φ (mm) | S1 POLE mT | N2 POLE mT | N4 POLE mT | N5 POLE mT | N2 POLE ° | N4 POLE ° | N5 POLE ° |
| 65 | 250 | 20 | 20 | 65 | 70 | 44 | 64 | 41 | 27 | 31 |
| 66 | 250 | 20 | 20 | 65 | 67 | 46 | 64 | 30 | 28 | 31 |
| 67 | 250 | 20 | 20 | 65 | 68 | 44 | 64 | 30 | 23 | 31 |
| 68 | 250 | 20 | 20 | 65 | 64 | 43 | 64 | 22 | 29 | 31 |
| 69 | 250 | 20 | 20 | 65 | 68 | 45 | 64 | 30 | 38 | 31 |
| 70 | 250 | 20 | 20 | 65 | 68 | 45 | 64 | 30 | 38 | 31 |
| 71 | 250 | 20 | 20 | 65 | 66 | 44 | 64 | 30 | 23 | 31 |
| 72 | 250 | 20 | 20 | 56 | 67 | 46 | 64 | 30 | 28 | 44 |
| 73 | 250 | 20 | 20 | 41 | 67 | 46 | 64 | 30 | 28 | 46 |
| 74 | 250 | 20 | 20 | 30 | 40 | 43 | 83 | 35 | 22 | 29 |
| 75 | 250 | 20 | 20 | 34 | 45 | 42 | 77 | 30 | 28 | 25 |
| 76 | 250 | 20 | 20 | 30 | 40 | 43 | 83 | 35 | 22 | 29 |
| 77 | 250 | 20 | 20 | 34 | 45 | 42 | 65 | 30 | 28 | 25 |
| 78 | 250 | 20 | 20 | 30 | 40 | 43 | 83 | 35 | 22 | 29 |
| 79 | 250 | 20 | 20 | 34 | 45 | 42 | 77 | 30 | 28 | 31 |
| 80 | 250 | 20 | 20 | 30 | 40 | 43 | 83 | 35 | 22 | 29 |

| | | | | | | | EVALUATION RESULT | |
|---|---|---|---|---|---|---|---|---|
| NO. | DMS mm | X mm | Y mm | α (N4 + N5)/X | β (N2 + N4)/Y | α/β | DRIVE UNEVENNESS | TRANSFER FAILURE |
| 65 | 0.25 | 2.8 | 11.9 | 38.1 | 9.6 | 4.0 | NO | NO |
| 66 | 0.25 | 2.9 | 10.1 | 38.1 | 11.2 | 3.4 | NO | NO |
| 67 | 0.25 | 2.8 | 9.3 | 39.0 | 11.9 | 3.3 | NO | NO |
| 68 | 0.25 | 2.9 | 8.9 | 36.3 | 12.0 | 3.0 | NO | NO |
| 69 | 0.25 | 3.9 | 11.9 | 27.7 | 9.5 | 2.9 | NO | NO |
| 70 | 0.5 | 4.2 | 11.9 | 26.1 | 9.5 | 2.7 | NO | NO |
| 71 | 1 | 3.5 | 9.3 | 31.3 | 11.9 | 2.6 | NO | NO |
| 72 | 0.25 | 4.8 | 10.1 | 23.0 | 11.2 | 2.1 | NO | YES |
| 73 | 0.25 | 5.1 | 10.1 | 21.5 | 11.2 | 1.9 | NO | YES |
| 74 | 0.25 | 2.5 | 9.9 | 50.6 | 8.3 | 6.1 | YES | NO |

TABLE 9-continued

| | | | | | | | | |
|---|---|---|---|---|---|---|---|---|
| 75 | 0.25 | 2.4 | 10.1 | 49.5 | 8.6 | 5.8 | YES | NO |
| 76 | 0.5 | 2.7 | 9.9 | 46.4 | 8.3 | 5.6 | YES | NO |
| 77 | 0.25 | 2.4 | 10.1 | 44.5 | 8.6 | 5.2 | NO | NO |
| 78 | 0.75 | 2.9 | 9.9 | 42.8 | 8.3 | 5.1 | NO | NO |
| 79 | 0.25 | 2.9 | 10.1 | 41.2 | 8.6 | 4.8 | NO | NO |
| 80 | 1 | 3.2 | 9.9 | 39.6 | 8.3 | 4.8 | NO | NO |

TABLE 10

| | DEVELOPER | | | MAGNETIC FORCE | | | | ANGLE | | |
|---|---|---|---|---|---|---|---|---|---|---|
| NO. | CONVEYANCE AMOUNT g/m$^2$ | DEVELOPING ROLLER φ (mm) | CONVEYOR ROLLER φ (mm) | S1 POLE mT | N2 POLE mT | N4 POLE mT | N5 POLE mT | N2 POLE ° | N4 POLE ° | N5 POLE ° |
| 81 | 300 | 20 | 20 | 65 | 70 | 44 | 64 | 41 | 27 | 31 |
| 82 | 300 | 20 | 20 | 65 | 67 | 46 | 64 | 30 | 28 | 31 |
| 83 | 300 | 20 | 20 | 65 | 66 | 44 | 64 | 30 | 23 | 31 |
| 84 | 300 | 20 | 20 | 65 | 64 | 43 | 64 | 22 | 29 | 31 |
| 85 | 300 | 20 | 20 | 65 | 68 | 45 | 64 | 30 | 38 | 31 |
| 86 | 300 | 20 | 20 | 65 | 68 | 45 | 64 | 30 | 38 | 31 |
| 87 | 300 | 20 | 20 | 65 | 66 | 44 | 64 | 30 | 23 | 31 |
| 88 | 300 | 20 | 20 | 56 | 67 | 46 | 64 | 30 | 28 | 44 |
| 89 | 300 | 20 | 20 | 41 | 67 | 46 | 64 | 30 | 28 | 46 |
| 90 | 300 | 20 | 20 | 30 | 40 | 43 | 83 | 35 | 22 | 29 |
| 91 | 300 | 20 | 20 | 34 | 45 | 42 | 77 | 30 | 28 | 25 |
| 92 | 300 | 20 | 20 | 30 | 40 | 43 | 83 | 35 | 22 | 29 |
| 93 | 300 | 20 | 20 | 34 | 45 | 42 | 65 | 30 | 28 | 25 |
| 94 | 300 | 20 | 20 | 30 | 40 | 43 | 83 | 35 | 22 | 29 |
| 95 | 300 | 20 | 20 | 34 | 45 | 42 | 77 | 30 | 28 | 31 |
| 96 | 300 | 20 | 20 | 30 | 40 | 43 | 83 | 35 | 22 | 29 |
| 97 | 300 | 20 | 20 | 0 | 40 | 43 | 83 | 35 | 22 | 29 |

| | | | | | | | EVALUATION RESULT | |
|---|---|---|---|---|---|---|---|---|
| NO. | DMS mm | X mm | Y mm | α (N4 + N5)/X | β (N2 + N4)/Y | α/β | DRIVE UNEVENNESS | TRANSFER FAILURE |
| 81 | 0.25 | 2.8 | 11.9 | 38.1 | 9.6 | 4.0 | NO | NO |
| 82 | 0.25 | 2.9 | 10.1 | 38.1 | 11.2 | 3.4 | NO | NO |
| 83 | 0.25 | 2.8 | 9.3 | 39.0 | 11.9 | 3.3 | NO | NO |
| 84 | 0.25 | 2.9 | 8.9 | 36.3 | 12.0 | 3.0 | NO | NO |
| 85 | 0.25 | 3.9 | 11.9 | 27.7 | 9.5 | 2.9 | NO | NO |
| 86 | 0.5 | 4.2 | 11.9 | 26.1 | 9.5 | 2.7 | NO | NO |
| 87 | 1 | 3.5 | 9.3 | 31.3 | 11.9 | 2.6 | NO | NO |
| 88 | 0.25 | 4.8 | 10.1 | 23.0 | 11.2 | 2.1 | NO | NO |
| 89 | 0.25 | 5.1 | 10.1 | 21.5 | 11.2 | 1.9 | NO | YES |
| 90 | 0.25 | 2.5 | 9.9 | 50.6 | 8.3 | 6.1 | YES | NO |
| 91 | 0.25 | 2.4 | 10.1 | 49.5 | 8.6 | 5.8 | YES | NO |
| 92 | 0.5 | 2.7 | 9.9 | 46.4 | 8.3 | 5.6 | YES | NO |
| 93 | 0.25 | 2.4 | 10.1 | 44.5 | 8.6 | 5.2 | YES | NO |
| 94 | 0.75 | 2.9 | 9.9 | 42.8 | 8.3 | 5.1 | YES | NO |
| 95 | 0.25 | 2.9 | 10.1 | 41.2 | 8.6 | 4.8 | NO | NO |
| 96 | 1 | 3.2 | 9.9 | 39.6 | 8.3 | 4.8 | NO | NO |
| 97 | 1 | 3.2 | 9.9 | 39.6 | 8.3 | 4.8 | YES | NO |

In Tables 6 to 10, when viewed in the cross-section perpendicular to the axial direction in the rotation of the developing roller 231 and the conveyor roller 232 (FIG. 9) as described above, the values of X and Y are calculated under the respective experimental conditions with the position on the circumference of the first sleeve 231B facing the peak position of the N4 pole set as the first outer peripheral position P1, the position on the circumference of the first sleeve 231B facing the peak position of the N2 pole set as the second outer peripheral position P2, the position on the circumference of the second sleeve 232B facing the peak position of the N5 pole set as the third outer peripheral position P3, the linear distance between the first and third outer peripheral positions P1 and P3 set as X (mm) and the distance on the peripheral surface of the first sleeve 231B between the first and second outer peripheral positions P1 and P2 set as Y (mm). Further, in Tables 6 to 10, α, β defined to be α=(A+C)/X, β=(A+B)/Y and α/β are calculated under the respective experimental conditions when the peak magnetic force of the N4 pole is A (mT), the peak magnetic force of the N2 pole is B (mT) and the peak magnetic force of the N5 pole is C (mT).

Further, the evaluation results given in the respective experiments relate to two points of drive unevenness and transfer failure. The drive unevenness is equivalent to an excessive amount of the developer of the retention portion TD (FIG. 6) and means the occurrence of rotation unevenness due to an increase of a drive torque of the developing roller 231. Note that the generation of development ghosts is suppressed even in this case. Further, the transfer failure means that part of the developer supposed to fly from the N4 pole to the N5 pole slightly moves toward the N2 pole by passing through the facing position TP. Note that the generation of development ghosts is suppressed even in this case.

Figure 11:
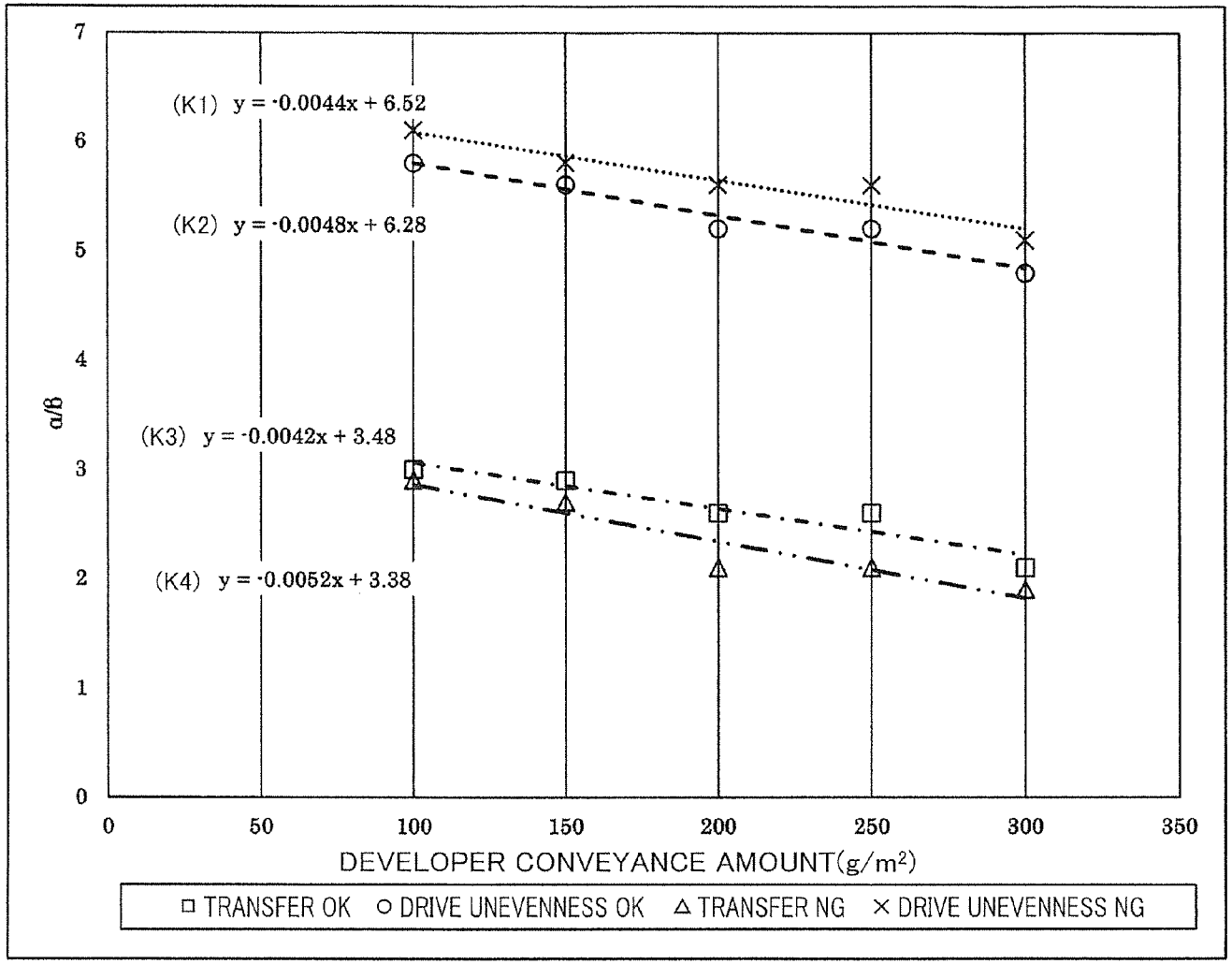
FIG. 11 is a graph showing a relationship of a developer conveyance amount and $\alpha/\beta$ in the examples of the first embodiment of the present disclosure.

The N4, N5 and N2 poles are repulsive to each other since having the same polarity. If the repulsive magnetic field between the N4 and N5 poles is too strong, the developer may be conveyed in a direction toward the N2 pole, although slight in amount, after being retained around the N4 pole. Thus, in terms of the transfer of the developer, a magnetic force-angle position relationship of the N4, N5 and N2 poles is important. The present disclosers newly found out optimal conditions of these three magnetic poles having the same polarity in a range of not smaller than 30 mT and not larger than 65 mT for the peak magnetic force of the N4 pole. FIG. 11 is a graph plotting evaluation results of the drive unevenness and the transfer failure based on the experimental results of Tables 6 to 10 with a horizontal axis representing the conveyance amount of the developer on the conveyor roller 232 regulated by the layer thickness regulating member 235 (FIG. 6) and a vertical axis representing $\alpha/\beta$. The drive unevenness occurs in a range of $\alpha/\beta$ above a regression line K1. Further, the drive unevenness does not occur at all in a range of $\alpha/\beta$ below a regression line K2. On the other hand, the transfer failure occurs in a range of $\alpha/\beta$ below a regression line K4. Further, the transfer failure does not occur at all in a range of $\alpha/\beta$ above a regression line K3.

The larger the amount of the magnetic force per unit distance (total magnetic force of two magnetic poles/distance between two magnetic poles) for the developer conveyed on the developing roller 231, the stronger the repulsive force. In the case of the present disclosure, the N4 and N5 poles are facing each other, but the N4 and N2 poles are adjacent. Further, a movement of the developer from the N4 pole to the N5 pole means the flying of the developer from the developing roller 231 to the conveyor roller 232. Thus, the repulsive magnetic force works (acts) differently between the N4 and N5 poles and between the N4 and N2 poles. Thus, the relationship of the aforementioned Equation 1 is desirably satisfied when the conveyance amount of the developer on the conveyor roller 232 regulated by the layer thickness regulating member 235 (FIG. 6) is M ($g/m^2$). In this case, the transfer of the developer between the magnetic poles having the same polarity is stably realized.

Note that when an evaluation similar to the above was made in a toner density range of not lower than 5% and not higher than 12% in each of Experiments 1 and 2, there was no change in the amount of the developer of the retention portion TD and similar results on the development ghost suppression effect, the transfer of the developer and the drive unevenness were obtained. Further, also when a similar evaluation was made in a range of not shorter than 16 mm and not longer than 35 mm for the diameters of the developing roller 231 and the conveyor roller 232 and in a range of not slower than 200 mm/sec and not faster than 400 mm/sec for the circumferential speed of the photoconductive drum 20, similar results on the development ghost suppression effect, the transfer of the developer and the drive unevenness were obtained.

Figure 12:
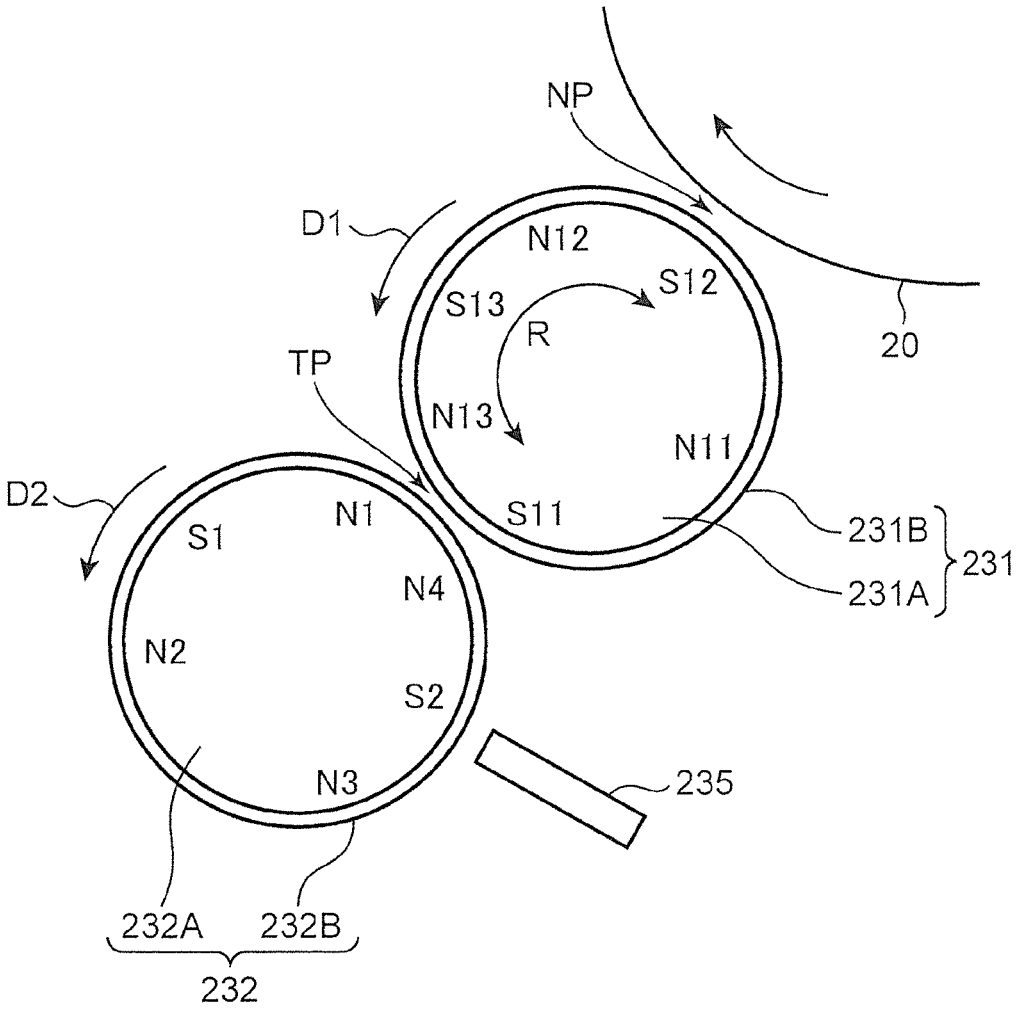
FIG. 12 is a schematic sectional view showing the arrangements of magnetic poles of a developing roller and a conveyor roller according to a second embodiment of the present disclosure.
Figure 13:
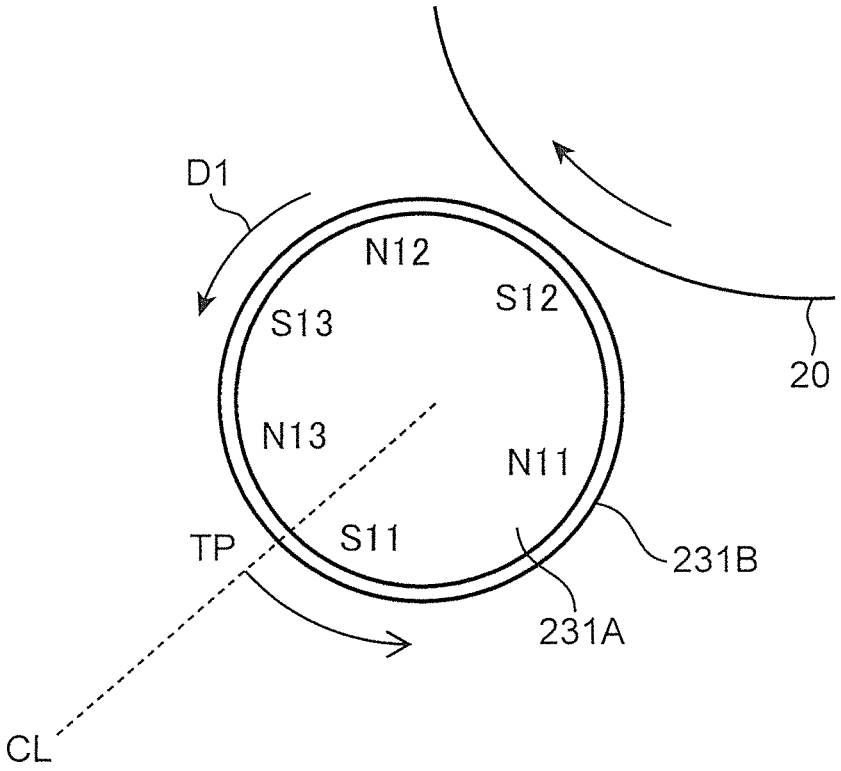
FIG. 13 is a schematic sectional view showing the arrangement of the magnetic poles of the developing roller according to the second embodiment of the present disclosure.
Figure 14:
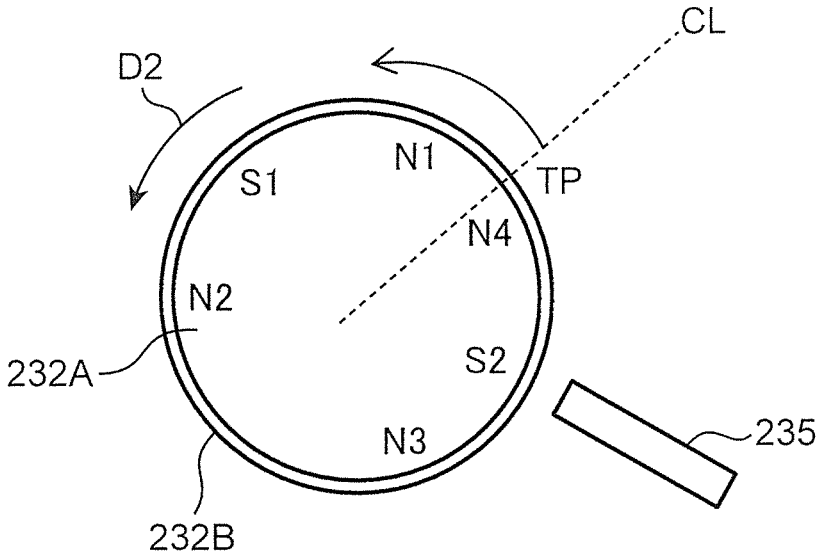
FIG. 14 is a schematic sectional view showing the arrangement of the magnetic poles of the conveyor roller according to the second embodiment of the present disclosure.
Figure 15:
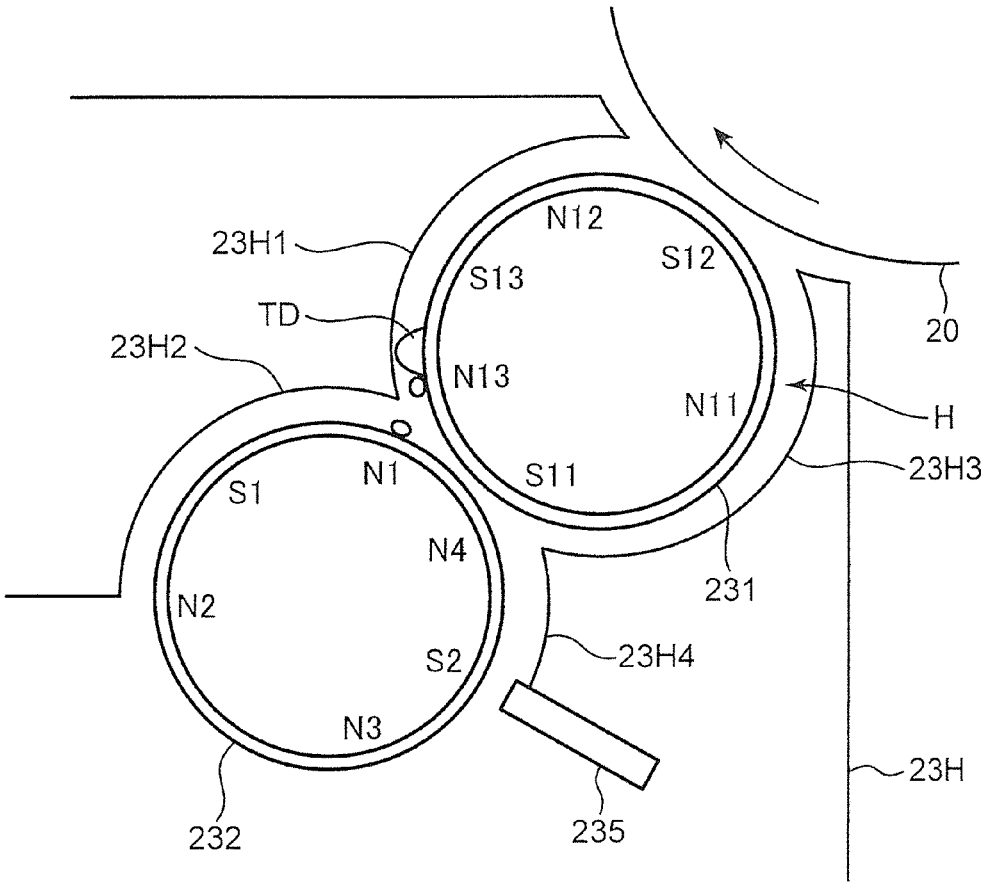
FIG. 15 is a schematic sectional view showing the structure of a housing of a developing device according to the second embodiment of the present disclosure and a state where a developer pool is generated.

Next, a developing device 23 according to a second embodiment of the present disclosure is described in detail with reference to FIGS. 12 to 15 in addition to FIGS. 1 and 2. Note that, in this embodiment, members having the same functions as in the previous first embodiment are denoted by the same reference signs as in the first embodiment in each figure. FIG. 12 is a schematic sectional view showing the arrangements of magnetic poles of a developing roller 231 and a conveyor roller 232 according to this embodiment. FIG. 13 is a schematic sectional view showing the arrangement of the magnetic poles of the developing roller 231. FIG. 14 is a schematic sectional view showing the arrangement of the magnetic poles of the conveyor roller 232. FIG. 15 is a schematic sectional view showing the structure of a housing 23H and a state where a developer pool (retention portion TD) is generated in the developing device 23 according to this embodiment. Note that since the configurations of a first magnet 231A of the developing roller 231 and a second magnet 232A of the conveyor roller 232 are mainly different from the previous first embodiment, this embodiment is described, centering on this point of difference.

With reference to FIGS. 12 and 13, the first magnet 231A of the developing roller 231 has six magnetic poles along a circumferential direction in this embodiment. An S11 pole (second magnetic pole) is arranged downstream of a facing position TP between the developing roller 231 and the conveyor roller 232 in a first rotational direction (D1). Further, an N11 pole is arranged downstream of the S11 pole in the first rotational direction. The N11 pole functions as a carrying pole for carrying developer received from the conveyor roller 232 toward a photoconductive drum 20. Further, an S12 pole functioning as a main pole for supplying toner to the photoconductive drum 20 is arranged downstream of the N11 pole in the first rotational direction. The S12 pole is arranged near the developing position NP.

Further, the first magnet 231A has three magnetic poles (N12, S13 and N13) in a first region R downstream of a developing position NP in the first rotational direction and upstream of the facing position TP in the first rotational direction. The N12 pole is arranged downstream of the S12 pole in the first rotational direction. The S13 pole is arranged further downstream of the N12 in the first rotational direction. The N13 pole (first magnetic pole) is a magnetic pole arranged adjacent to and downstream of the S13 pole in the first rotational direction and upstream of the facing position TP in the first rotational direction and having a polarity different from the S13 pole. Further, the aforementioned S11 pole is a magnetic pole arranged adjacent to and downstream of the N13 pole in the first rotational direction across the facing position TP and having a polarity different from the N13 pole.

Table 11 shows a magnet with angles and magnetic forces (peak values of radial components) of six magnetic poles illustrated as the first magnet 231A according to this embodiment. Note that the angle of each magnetic pole shown in Table 11 is shown along the first rotational direction with the facing position TP of FIG. 13 as a starting point (angle) 0°. In FIG. 13, a straight line CL connecting the facing position TP and a rotation axis center of the developing roller 231 (straight line connecting the rotation axis center of the developing roller 231 and that of the conveyor roller 232) is shown as the above starting point.

TABLE 11

| MAGNETIC POLE | MAGNETIC FORCE | ANGLE |
|---|---|---|
| S11 | 52 mT | 29° |
| N11 | 71 mT | 105° |
| S12 | 88 mT | 181° |
| N12 | 66 mT | 229° |
| S13 | 48 mT | 281° |
| N13 | 42 mT | 330° |

On the other hand, with reference to FIGS. 12 and 14, the second magnet 232A of the conveyor roller 232 has six magnetic poles along a circumferential direction. An N1 pole (fourth magnetic pole) is arranged downstream of the facing position TP between the developing roller 231 and the conveyor roller 232 in a second rotational direction (D2). Further, an S1 pole (fifth magnetic pole) and an N2 pole are arranged downstream of the N1 pole in the second rotational direction. Furthermore, an N3 pole is arranged downstream of and at a distance from the N2 pole in the second rotational direction. The N2 pole functions as a peeling pole for peeling the developer from the conveyor roller 232. The N3 pole functions as a draw-up pole for drawing up the developer from a first screw 233A. An S2 pole and an N4 pole (third magnetic pole) are arranged downstream of the N3 pole in the second rotational direction. As shown in FIG. 14, a layer thickness regulating member 235 described above is arranged upstream of the N4 pole in the second rotational direction and to face at a predetermined distance from a second sleeve 232B of the conveyor roller 232 near the S2 pole. In this embodiment, the S2 pole functions as a regulating pole. Thus, a layer thickness of the developer can be stably regulated before the developer is transferred from the conveyor roller 232 to the developing roller 231. Note that the N4 pole is arranged upstream of the facing position TP in the second rotational direction and the N1 pole is arranged adjacent to and downstream of the N4 pole in the second rotational direction across the facing position TP.

Table 12 shows angles and magnetic forces (peak values of radial components) of six magnetic poles as an example of the second magnet 232A according to this embodiment. The angle of each magnetic pole shown in Table 12 is shown along the second rotational direction with the facing position TP of FIG. 14 as a starting point (angle) 0°. Note that a straight line CL connecting the facing position TP and the rotation axis center of the conveyor roller 232 (straight line connecting the rotation axis center of the developing roller 231 and that of the conveyor roller 232) is shown as the above starting point in FIG. 14.

TABLE 12

| MAGNETIC POLE | MAGNETIC FORCE | ANGLE |
|---|---|---|
| N1 | 48 mT | 30° |
| S1 | 72 mT | 101° |
| N2 | 38 mT | 172° |
| N3 | 46 mT | 205° |
| S2 | 68 mT | 268° |
| N4 | 31 mT | 331° |

Figure 16:
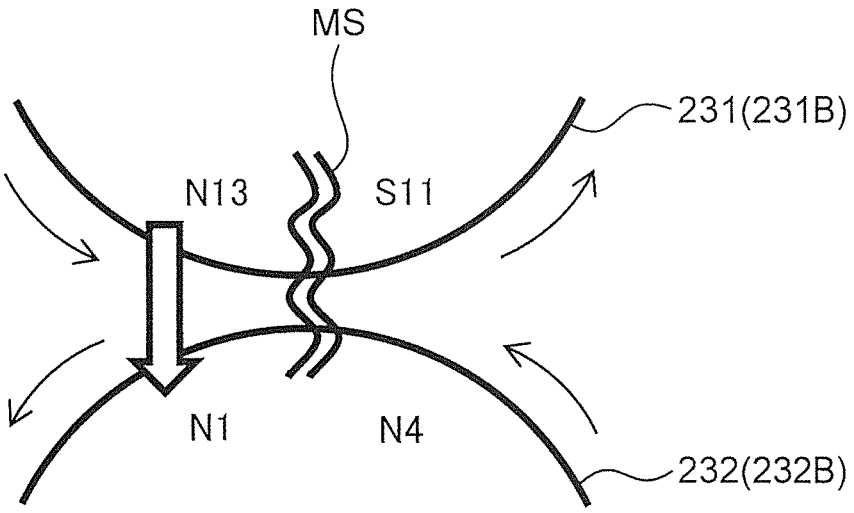
FIG. 16 is a diagram showing the periphery of a facing position between the developing roller and the conveyor roller of the developing device according to the second embodiment of the present disclosure.

Further, the arrangement and functions of four magnetic poles arranged around the facing position TP out of the first magnet 231A of the developing roller 231 and the second magnet 232A of the conveyor roller 232 are further described. FIG. 16 is a diagram showing the periphery of the facing position TP between the developing roller 231 and the conveyor roller 232 of the developing device 23 according to this embodiment. The N13 pole of the first magnet 231A and the N1 and N4 poles of the second magnet 232A are magnetic poles having a polarity different from the S11 pole of the first magnet 231A. The developer having passed through the developing position NP is transferred from the developing roller 231 to the conveyor roller 232 by a magnetic field formed by the N13 and N1 poles. Further, the developer supplied from the first screw 233A of a stirring screw 233 to the conveyor roller 232 is transferred from the conveyor roller 232 to the developing roller 231 by a magnetic field formed by the N4 and S11 poles after being regulated by the layer thickness regulating member 235.

With reference to FIG. 15, the housing 23H includes a plurality of inner wall portions facing the developing roller 231 and the conveyor roller 232. Specifically, the housing 23H includes a first inner wall portion 23H1, a second inner wall portion 23H2, a third inner wall portion 23H3 and a fourth inner wall portion 23H4. The first inner wall portion 23H1 faces the N12, S13 and N13 poles and extends along the peripheral surface of a first sleeve 231B of the developing roller 231 from the developing position NP to a position facing the N13 pole. The second inner wall portion 23H2 is connected to the first inner wall portion 23H1, faces the N1 and S1 poles and extends along the peripheral surface of the second sleeve 232B of the conveyor roller 232. Similarly, the third inner wall portion 23H3 faces the N11 and S11 poles on a side opposite to the first inner wall portion 23H1 and extends along the peripheral surface of the first sleeve 231B of the developing roller 231 from the developing position NP to a position facing the S11 pole. The first sleeve 231B of the developing roller 231 is arranged to be partially exposed and face the photoconductive drum 20 between the first and third inner wall portions 23H1, 23H3. The fourth inner wall portion 23H4 is connected to the third inner wall portion 23H3, faces the N4 and S2 poles and extends along the peripheral surface of the second sleeve 232B of the conveyor roller 232. Note that, as shown in FIG. 15, substantially equal clearances H (conveyance path for the developer) are formed between the respective inner wall portions and the first sleeve 231B of the developing roller 231 and the second sleeve 232B of the conveyor roller 232. In this embodiment, heights of these clearances H are smaller than radii of the developing roller 231 and the developing roller 232 and set in a range of 0.5 mm to 2.0 mm. Note that a part of the housing 23H including the third and fourth inner wall portions 23H3, 23H4 is desirably detachable since the position of the layer thickness regulating member 235 needs to be adjusted.

Also in this embodiment, it is suitably suppressed that a thin toner layer is formed on the developing roller 231, which is one roller facing the photoconductive drum 20, and ghost images as described above are generated in the developing device 23 in which two magnetic rollers (developing roller 231, conveyor roller 232) are arranged. Specifically, the developing roller 231 of the developing device 23 has the aforementioned N13 pole and the conveyor roller 232 has the N1 pole to suppress such ghost images (FIG. 16).

By arranging the magnetic poles having the same polarity opposite to each other in a part where the developer is transferred from the developing roller 231 to the conveyor roller 23 in this way, a repulsive magnetic field is formed by the N13 and N1 poles. In this case, the developer conveyed from the N12 pole to the S13 pole and further to the N13 pole of the developing roller 231 cannot immediately move toward the conveyor roller 232 since the facing N1 pole has the same polarity as the N13 pole as shown in FIG. 15. Further, the N4 pole having the same polarity as the N1 pole is arranged also on an upstream side in the second rotational direction of the conveyor roller 232. Thus, a magnetic shield MS is formed near the facing position TP (FIG. 16). The developer is partially retained on the developing roller 231 on the N13 pole by the repulsive magnetic field between the N13 and N1 poles. As a result, the retention portion TD of the developer is formed on the first sleeve 231B of the developing roller 231. In the retention portion TD, a magnetic brush of the developer is retained while slipping on the first sleeve 231B. Thus, even if a history of toner consumed at the developing position NP remains in a toner layer on the first sleeve 231B, the history of the toner is eliminated (polished) by the magnetic brush of the developer retained in the retention portion TD. Thus, the developing device 23 having the generation of ghosts as described above suppressed is provided. Particularly, when a peak position of a magnetic pole is not present at the facing position TP between the developing roller 231 and the conveyor roller 232 as in this embodiment, a polishing force (scraping force) of the magnetic brush of the developer on the conveyor roller 232 is less likely to reach the surface of the first sleeve 231B. Even in such a case, the retention portion TD can be suitably formed by a repulsive force between the N13 and N1 poles between the developing roller 231 and the conveyor roller 232.

The developer that can be no longer held by the magnetic force of the N13 pole eventually flies from the retention portion TD. In this embodiment, a linear distance between the N13 and N1 poles is shorter than a circumferential distance between the N13 and S11 poles. As a result, the developer having flown from the periphery of the N13 pole moves toward the N1 pole. Thereafter, the developer is separated from the conveyor roller 232 while being smoothly conveyed by a magnetic force formed by the N1, S1 and N2 poles successively and adjacently arranged and having different polarities in addition to the rotation of the second sleeve 232B of the conveyor roller 232.

Further, also in this embodiment, one developing roller is arranged to face the photoconductive drum 20 and develops an electrostatic latent image on the photoconductive drum 20. Thus, the electrostatic latent image needs to be stably developed at one developing position NP as compared to another developing device in which a plurality of developing rollers are adjacently arranged along the peripheral surface of the photoconductive drum 20. Thus, the next rotation of the history of the toner layer toward the developing position NP can be suitably suppressed by arranging the magnetic poles having the same polarity between two rollers as described above. As a result, the complication of the structure of the developing device 23 is suppressed and a cost increase of the developing device 23 is suppressed.

Further, also in this embodiment, the first sleeve 231B is formed of a circular pipe member (base member) made of aluminum. Further, sandblasting (blasting) is applied to the peripheral surface of the circular pipe member of the first sleeve 231B and the circular pipe member includes a Ni plating layer applied on the peripheral surface thereof. Thus, the developer easily slips due to a surface property of the first sleeve 231B having blasting applied thereto and the retention portion TD of the developer is stably formed. Further, a charge amount of positively chargeable toner is easily reduced by a plating layer on the developing roller 231. As a result, a charge amount of the developer is reduced, the slip of the developer in the retention portion TD is promoted and an adhering force of the toner to the sleeve surface becomes smaller. Thus, the generation of ghost images is further suppressed. Note that the first sleeve 231B of the developing roller 231 may have a known groove shape instead of having blasting applied in another embodiment.

Further, in this embodiment, the S11 pole is arranged downstream of the N13 pole in the first rotational direction and the N4 pole is arranged upstream of the N1 pole in the second rotational direction. The developer can be stably supplied from the conveyor roller 232 to the developing roller 231 by a magnetic field formed by the N4 and S11 poles. The developer transferred from the conveyor roller 232 to the developing roller 231 is, thereafter, used to develop an electrostatic latent image on the photoconductive drum 20 at the developing position NP. Thus, it is desirable to transfer the developer without collapsing the magnetic brush of the developer by a magnetic field formed by the magnetic poles having different polarities. On the other hand, the developer transferred from the developing roller 231 to the conveyor roller 233 is the developer having passed through the developing position NP. Thus, the developer may be transferred with the magnetic brush of the developer collapsed by a repulsive magnetic field formed by the magnetic poles having the same polarity. Therefore, in this embodiment, the retention portion TD of the developer can be formed in a region where the developer is transferred from the developing roller 231 to the conveyor roller 232.

Here, a problem in an assumed case where the Sil pole is not arranged in FIG. 16 is further described. In this case, only three N poles having the same polarity are arranged near the closest position of the two rollers. In such a configuration, since a repulsive magnetic field is concentrated, a magnetic field formed among the magnetic poles is largely affected if the magnetic force or position of one magnetic pole out of three N poles even slightly changes. As a result, a flying state of the developer easily changes and, further, a phenomenon in which a large amount of the developer passes through the facing position TP easily occurs. Further, since the three N poles are repulsive to each other, it is difficult to set the angles of the magnetic poles of the first and second magnets 231A, 232A. Unillustrated fixing shafts are arranged on axial end parts of the first and second magnets 231A, 232A. End parts of these fixing shafts have a D cut shape and positioning members to be fitted to the magnets having a D cut shape are mounted on the housing 23H. As a result, the angle positions of the magnetic poles of the first and second magnets 231A and 232A in the developing device 23 are determined. However, if the S11 pole of this embodiment is not provided as described above, the repulsive magnetic field may vary within ranges of a magnetic force tolerance and a magnetic pole position tolerance depending on conveyance conditions of the developer since the three N poles are repulsive to each other. As a result, an unstable magnetic field is generated within a range of a fitting play (clearance) of the D cut shapes. This variation of the magnetic field appears as image unevenness at the developing position NP during an image forming operation. Further, since the position of the N3 pole of the second magnet 232A also varies in this case, the amount of the developer supplied from the first screw 233A (FIG. 2) to the conveyor roller 232 also easily varies. As just described, in a configuration in which only the magnetic poles having the same polarity are arranged at the facing position TP, the transfer of the developer among the stirring screw 233, the conveyor roller 232 and the developing roller 231 tends to be unstable.

On the other hand, since the S11 and N4 poles having different polarities attract each other in this embodiment, magnetic lines of force are formed between the both. As a result, magnetic lines of force formed between the N13 and S11 poles are extremely reduced. Thus, it is suppressed that the S11 and N4 poles largely affect the repulsive magnetic field formed between the N13 and N1 poles, and the magnetic field around the facing position TP is easily stabilized. As just described, in this embodiment, the S11 pole is arranged on the side of the conveyor roller 232 in the developer transfer region from the conveyor roller 232 to the developing roller 231. The S11 pole is a magnetic pole having a polarity different from the N4, N13 and N1 poles similarly having a developer transfer function. To prevent the developer having a stable toner density from moving from the N4 pole toward the N1 pole to be conveyed toward the developing position NP, the S11 pole having a different polarity out of the four magnetic poles is preferably located on the side of the first magnet 231A rather than on the side of the second magnet 232A (FIG. 16).

Note that as the amount of the developer retained on the N13 pole increases, an effect of cleaning the toner layer on the first sleeve 231B becomes higher. Thus, the repulsive magnetic field between the N13 and N1 poles is desirably stronger for the cleaning effect. To make the retention portion TD easily grow, it is desirable to arrange the S13 pole upstream of the N13 pole in the first rotational direction at a position near the N13 pole in addition to the repulsive magnetic field between the N13 and N1 poles. Particularly, the S13 pole is further desirably arranged at a position closer to the N13 pole than the S11 pole. In this case, magnetic lines of force extending from the S13 pole to the N13 pole become stronger and the retention portion TP is formed to be larger. Note that a degree of influence of this S13 pole on the retention portion TD can be expressed by a horizontal component (also called a tangential component) of the magnetic force between the S13 and N13 poles. The stronger the horizontal component of the magnetic force between the both poles, the larger the retention portion TD formed. Further, as a peak position of the horizontal component of the magnetic force becomes closer to the N13 pole, the retention portion TD increases and a toner layer cleaning property is improved. In other words, the arrangement of the magnetic poles of the first magnet 231A is desirably set such that the peak position of the horizontal component between the S13 and N13 poles is closer to the N13 pole than a point where a vertical component (also called a radial component) of the magnetic force between the both poles is 0.

Next, the second embodiment of the present disclosure is further described on the basis of examples. Note that the present disclosure is not limited to the following examples. Each experiment described below was conducted under the following experimental conditions.

<Experimental Conditions>

Print speed: 55 sheets/min

Photoconductive drum 20: amorphous silicon photoconductor (a-Si) having a diameter (φ) of 30 mm, surface potentials Vo (blank part, background part)=+270 V and VL (image part)=+20V and a circumferential speed=300 mm/sec Gap between layer thickness regulating member 235 and second sleeve 232B: 200 to 600 μm Developer conveyance amount (after layer thickness regulation) on conveyor roller 232, developing roller 231: 100 to 300 g/m$^2$ Carrier: ferrite resin coated carrier having a volume average particle diameter of 35 μm and a magnetic force of 80 emu/g Toner: a volume average particle diameter of 6.8 μm, a toner density of 7%, positively charging property Conditions of the developing roller 231 are as follows.

Developing roller 231: a diameter φ of 20 mm

Circumferential speed ratio of the developing roller 231 to photoconductive drum 20: 1.8 (same direction at the facing position, with direction)

Gap between developing roller 231 and photoconductive drum 20: 300 μm

Development bias: DC bias=170 V, AC bias=Vpp 1.4 kV, a frequency f of 3.7 kHz, a duty ratio of 50%, rectangular wave (note that the conveyor roller 232 and the layer thickness regulating member 235 also have the same potential).

Surface conditions of first sleeve 231B:

(Condition 1) Sandblasting (Rzjis=7 μm), Ni plating (Condition 2) Sandblasting (Rzjis=7 μm), no plating Further, a magnetic pole distribution of the developing roller 231 used in the experiments is as shown in the previous Table 11. Note that magnetic forces of the developing roller 231 and the conveyor roller 232 were measured using a GAUSS METER Model GX-100 produced by Nihon Denji Sokki Co., Ltd.

Further, conditions of the conveyor roller 232 used in the experiments are as follows.

Conveyor roller 232: a diameter φ of 20 mm

Surface conditions of second sleeve 232B: knurled V grooves (groove depth of 80 μm, groove width of 0.2 mm, the number of grooves of 120)

Circumferential speed ratio of conveyor roller 232 to developing roller 231: 1.4 (opposite directions at the facing position, counter directions)

Gap between conveyor roller 232 and developing roller 231: 250 μm

Further, a magnetic pole distribution of the conveyor roller 232 used in the experiments is as shown in the previous Table 12.

Figure 17:
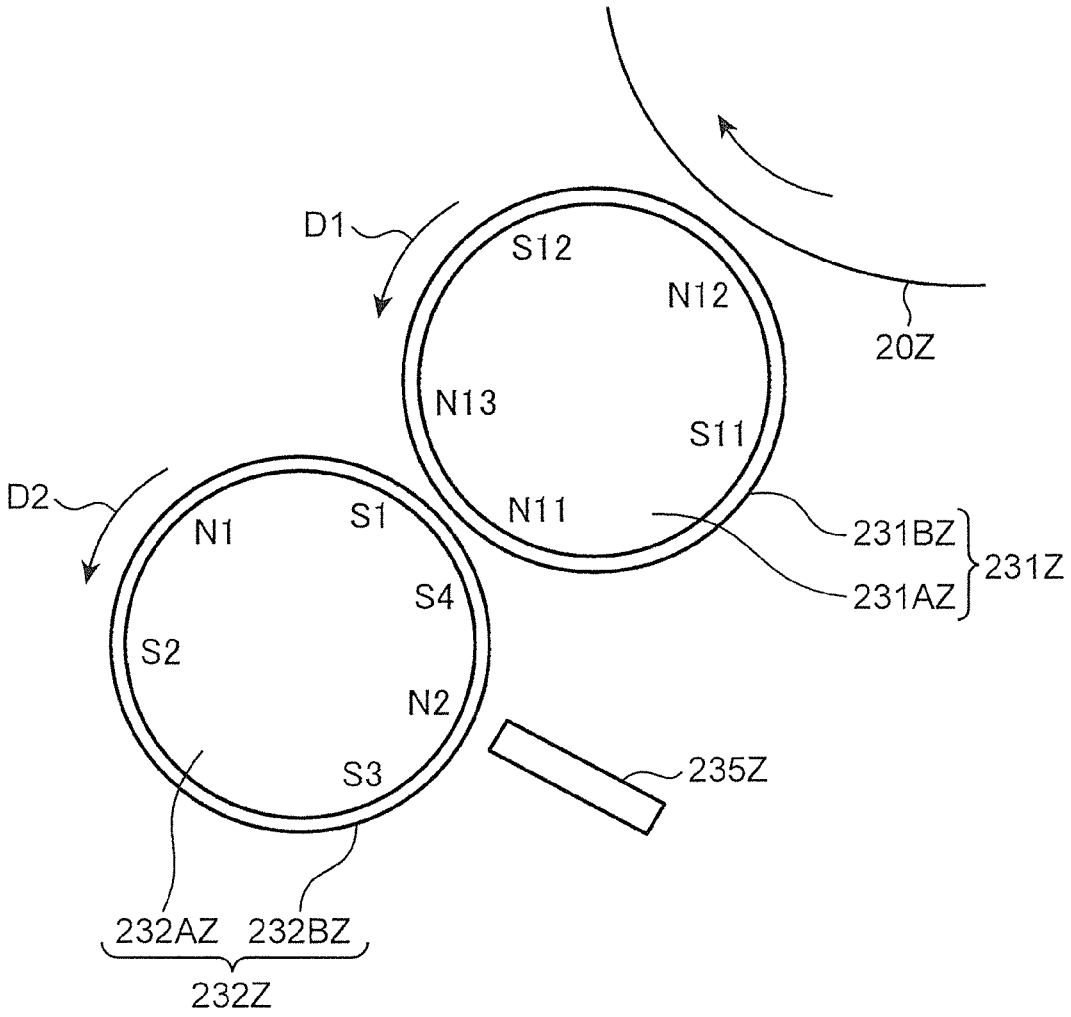
FIG. 17 is a schematic sectional view showing the arrangements of magnetic poles of a developing roller and a conveyor roller of another developing device to be compared with the developing device according to the second embodiment of the present disclosure.

An example having no Ni plating applied thereto (Condition 2) and an example having Ni plating applied thereto (Condition 1) in the surface conditions of the first sleeve 231B in the above experimental conditions were respectively set as Example 2-1 and Example 2-2. Further, a developing device of Comparative Example 2-1 to be compared with Example 2-1 and Example 2-2 is shown in FIG. 17. This developing device includes a developing roller 231Z arranged to face a photoconductive drum 20Z and a conveyor roller 232Z arranged to face the developing roller 231Z. Note that the structures of a housing and the like are as in Example 2-1 and Example 2-2 (FIG. 15). Particularly, in Comparative Example 2-1, the developer is transferred from the developing roller 231Z to the conveyor roller 232Z by a magnetic field formed by N13 and 51 poles having different polarities at a facing position where the developing roller 231Z and the conveyor roller 232Z are facing each other.

Under the above conditions, a ghost confirmation pattern image shown in FIG. 8 was printed and an evaluation was made based on the number of generated ghosts. The ghosts are counted up to the fourth turn from the original image and a maximum of 20 ghosts are generated per print. Further, the above evaluation was made with the development AC bias Vpp changed in five levels of 1.0 kV, 1.2 kV, 1.4 kV, 1.6 kV and 1.8 kV (a total maximum of 100 ghosts were generated). A ghost evaluation result in Example 2-1, Example 2-2 and Comparative Examples 2-1 is shown in Table 13.

TABLE 13

| | COMPARATIVE EXAMPLE 2-1 | EXAMPLE 2-1 | EXAMPLE 2-2 |
|---|---|---|---|
| Ni PLATING | NO | NO | YES |
| GHOST | 35 | 23 | 14 |

As shown in Table 13, in Example 2-1, Example 2-2 conducted as examples of the second embodiment of the present disclosure, the number of the generated ghosts was improved as compared to Comparative Example 2-1. Further, the ghosts were largely improved by applying plating to the first sleeve 231B as in Example 2-2. For the positively chargeable toner, toner chargeability is reduced and the retention portion TD is stably formed by applying Ni plating to the first sleeve 231B. Note that if the surface of aluminum or SUS is exposed on the surface of the first sleeve 231B, a passivation layer is formed on the surface in either case. This passivation layer is negatively chargeable and has a property of increasing the charge amount of the positively chargeable toner. If the toner adhering onto the first sleeve 231B of the developing roller 231 is charged by the above passivation layer, an image force of the toner is increased and the toner is less likely to be separated from the surface of the sleeve 231B. In contrast, the Ni plating is positively chargeable and tends to reduce the charge amount of the toner. As a result, the cleaning property at the N13 pole is increased due to the slipperiness of the plating layer and the toner is less charged, wherefore ghosts are more eliminated.

Note that, as a result of a similar evaluation in a Rzjis range of not smaller than 4 μm and not larger than 14 μm, it was found that results similar to the above were obtained for Conditions 1 and 2 of the first sleeve 231B. Further, it was confirmed that there was no difference in Rzjis of the first sleeve 231B after and before plating if a film thickness of the Ni plating is in a range of not smaller than 3 μm and not larger than 5 μm.

Note that when an evaluation similar to the above was made in a toner density range of not lower than 5% and not higher than 12% in the above experiment, there was no change in the amount of the developer of the retention portion TD and a similar result on the development ghost suppression effect was obtained. Further, also when a similar evaluation was made in a range of not shorter than 16 mm and not longer than 35 mm for the diameters of the developing roller 231 and the conveyor roller 232 and in a range of not slower than 200 mm/sec and not faster than 400 mm/sec for the circumferential speed of the photoconductive drum 20, a similar result on the development ghost suppression effect was obtained.

Figure 18:
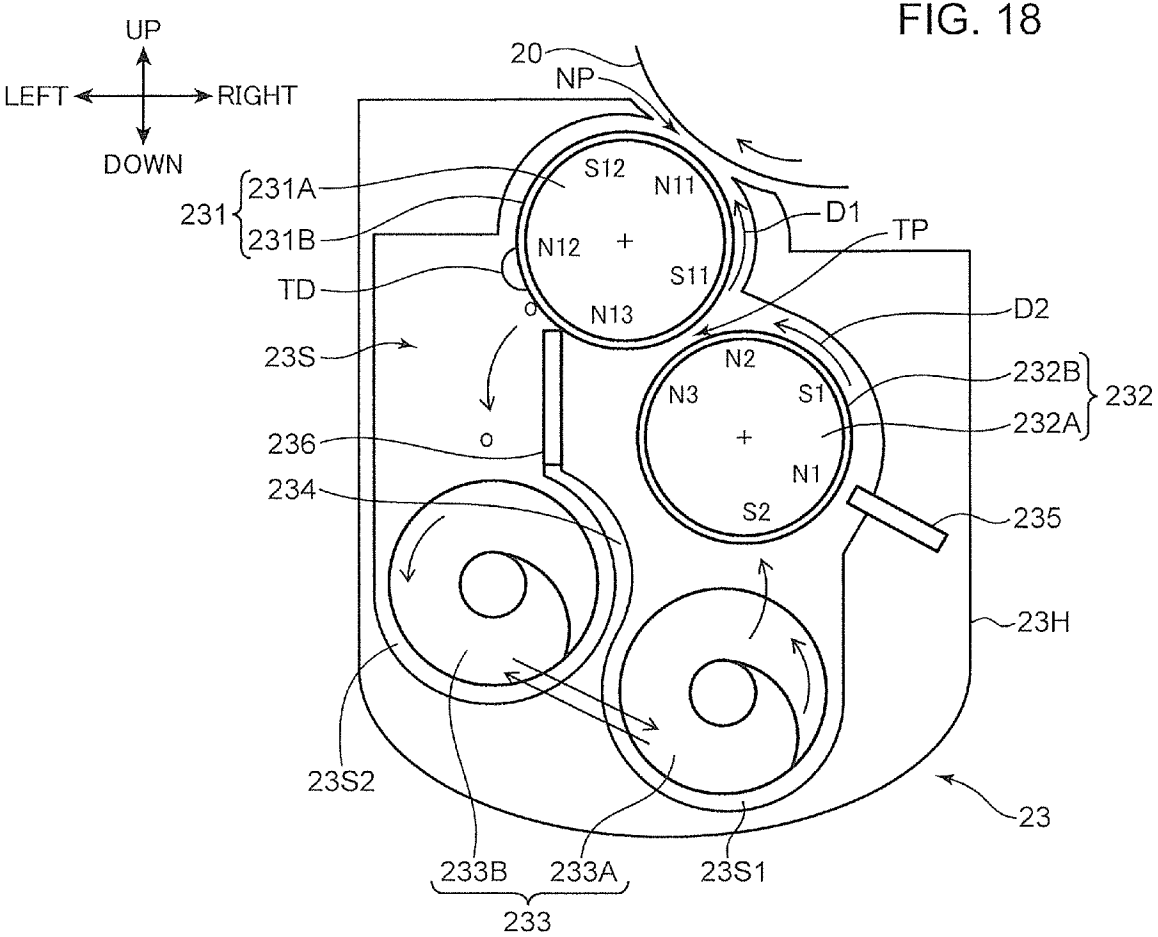
FIG. 18 is a schematic sectional view showing an internal structure of a developing device according to a third embodiment of the present disclosure.
Figure 19:
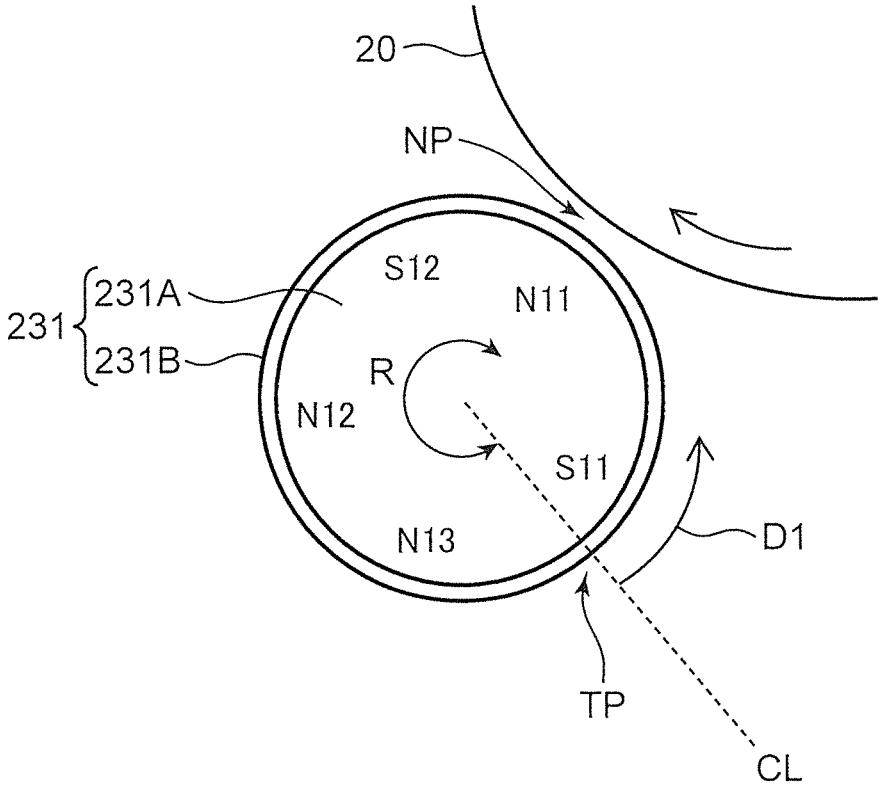
FIG. 19 is a schematic sectional view showing the arrangement of magnetic poles of a developing roller according to the third embodiment of the present disclosure.
Figure 20:
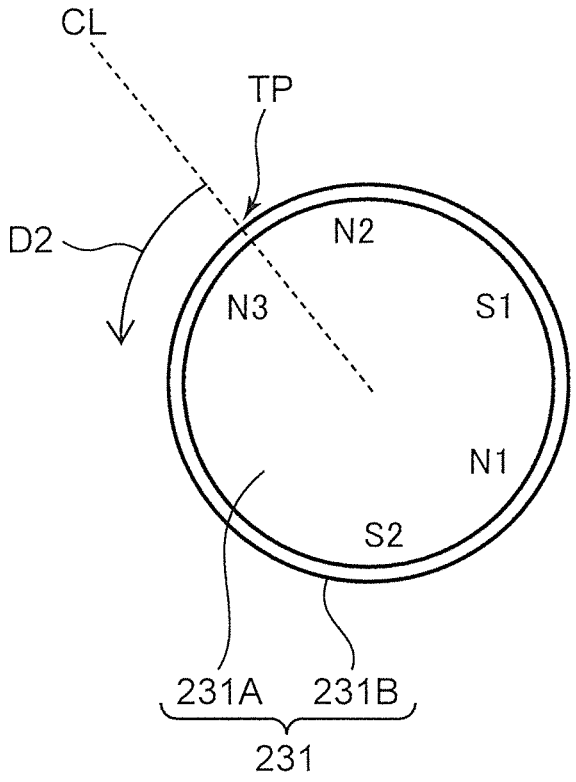
FIG. 20 is a schematic sectional view showing the arrangement of magnetic poles of a conveyor roller according to the third embodiment of the present disclosure.

Next, a developing device 23 according to a third embodiment of the present disclosure is described in detail with reference to FIGS. 18 to 20 in addition to FIG. 1. Note that, in this embodiment, members having the same functions as in the previous first embodiment are denoted by the same reference signs as in the first embodiment in each figure. FIG. 18 is a schematic sectional view showing an internal structure of the developing device 23 according to this embodiment. In FIG. 18, a rotational direction of each rotary member of the developing device 23 is shown by an arrow. FIG. 19 is a schematic sectional view showing the arrangement of magnetic poles of a developing roller 231. FIG. 20 is a schematic sectional view showing the arrangement of magnetic poles of a conveyor roller 232. Note that since the configurations of a first magnet 231A of the developing roller 231 and a second magnet 232A of the conveyor roller 232 are different from the previous first embodiment, this embodiment is described, centering on this point of difference.

With reference to FIG. 18, the developing device 23 includes a housing 23H, the developing roller 231, the conveyor roller 232, a stirring screw 233 (developer stirring unit) with two screws, a partition plate 234, a layer thickness regulating member 235 and a separator 236 (peeling member). The housing 23H is a casing body for supporting each member of the developing device 23.

The stirring screw 233 charges the toner by conveying two-component developer in a circulating manner while stirring this developer. The stirring screw 233 includes a first screw 233A (first conveying member) and a second screw 233B (second conveying member). The first screw 233A supplies the developer in a predetermined direction (rearward direction) along a horizontal direction. The second screw 233B conveys the developer in an opposite direction (forward direction) to that of the first screw 233A along the horizontal direction and collects the developer peeled from the developing roller 231.

Note that, as shown in FIG. 18, the housing 23H includes a first conveying portion 23S1 in which the first screw 233A is arranged and a second conveying portion 23S2 in which the second screw 233B is arranged. The first and second conveying portions 23S1, 23S2 communicate with each other at both axial (longitudinal) end parts. Further, as shown in FIG. 18, the second conveying portion 23S2 is arranged above the first conveying portion 23S2. The developer is conveyed in a circulating manner between the first and second conveying portions 23S1, 23S2 by conveying forces of the first and second screws 233A, 233B. The first screw 233A supplies the developer to the conveyor roller 232. The partition plate 234 is a plate-like member provided in the housing 23H. The partition plate 234 partitions between the first and second conveying portions 23S1, 23S2 along axial directions of the first and second screws 233A, 233B. Further, the toner supplied from a toner supplying unit 15 flows into the housing 23H from one axial end side of the second screw 233B and is stirred with the other developer.

The layer thickness regulating member 235 is a plate-like member made of nonmagnetic metal and arranged to face the peripheral surface of the conveyor roller 232. Note that a magnetic member may be fixed to an upstream side surface of the layer thickness regulating member 235 in another embodiment. The layer thickness regulating member 235 regulates a layer thickness of the developer supplied to the conveyor roller 232 from the first screw 233A of the stirring screw 233.

The separator 236 is arranged to face the developing roller 231 and peels the developing roller from the first sleeve 231B. A tip part of the separator 236 is arranged with a predetermined clearance defined between this tip part and the first sleeve 231B. The separator 236 is formed of a plate-like member made of metal or rubber.

Further, as shown in FIG. 18, an axial center of the developing roller 231 is arranged below that of the photoconductive drum 20 and an axial center of the conveyor roller 232 is arranged further below that of the conveyor roller 231. Further, when viewed in a cross-section perpendicular to the axial center of the developing roller 231, the axial center of the developing roller 231 is arranged at a predetermined distance from the axis center of the photoconductive drum 20 on one end of (left side) in a horizontal direction. Further, the axial center of the conveyor roller 232 is arranged between that of the developing roller 231 and that of the photoconductive drum 20 in the horizontal direction.

Further, with reference to FIG. 18, the developer composed of the toner and the carrier and conveyed in a circulating manner by the stirring screw 233 is supplied from the first screw 233A to the conveyor roller 232. Thereafter, this developer is supplied to the developing roller 231 after the layer thickness of the developer is regulated by the layer thickness regulating member 235. After part of the toner is supplied to the photoconductive drum 20 at the developing position NP, the developer peeled from the developing roller 231 freely falls to be collected by the second screw 233B. Thereafter, the collected developer is conveyed in a circulating manner by the stirring screw 233.

With reference to FIGS. 18 and 19, the first magnet 231A of the developing roller 231 has five magnetic poles along the circumferential direction. An S11 pole (second magnetic pole) is arranged downstream of the facing position TP between the developing roller 231 and the conveyor roller 232 in the first rotational direction (D1). Further, an N11 pole is arranged downstream of the S11 pole in the first rotational direction. The N11 pole functions as a main pole for supplying the toner to the photoconductive drum 20. The N11 pole is arranged near the developing position NP.

Further, the first magnet 231A has three magnetic poles (S12, N2 and N13 poles) in a first region R downstream of the developing position NP in the first rotational direction and upstream of the facing position TP in the first rotational direction. The N12 pole (fifth magnetic pole) is arranged in a substantially central part of the first region R. The N13 pole (first magnetic pole) is a magnetic pole arranged adjacent to and downstream of the N12 pole in the first rotational direction and having the same polarity as the N12 pole. The S12 pole is a magnetic pole arranged adjacent to and upstream of the N12 pole in the first rotational direction and having a polarity different from the N12 pole. The S12 pole functions to convey the developer having passed through the developing position NP toward the N12 pole. Further, the aforementioned S11 pole is a magnetic pole arranged adjacent to and downstream of the N13 pole in the first rotational direction across the facing position TP and having a polarity different from the N13 pole.

Table 14 shows angles and peak magnetic forces of radial components of five magnetic poles as an example of the first magnet 231A according to this embodiment. Further, the angle of each magnetic pole shown in Table 14 is shown along the first rotational direction with the facing position TP of FIG. 19 as a starting point (angle) 0°. Note that a straight line CL connecting the facing position TP and a rotation axis center of the developing roller 231 (straight line connecting the rotation axis center of the developing roller 231 and that of the conveyor roller 232) is shown in FIG. 19 as the starting point.

TABLE 14

| MAGNETIC POLE | ANGLE | MAGNETIC FORCE |
|---|---|---|
| S11 | 30° | 75 mT |
| N11 | 90° | 100 mT |
| S12 | 140° | 80 mT |
| N12 | 210° | 65 mT |
| N13 | 310° | 45 mT |

On the other hand, with reference to FIGS. 18 and 20, the second magnet 232A of the conveyor roller 232 has five magnetic poles along the circumferential direction. An N3 pole (fourth magnetic pole) is arranged downstream of the facing position TP between the developing roller 231 and the conveyor roller 232 in the second rotational direction (D2). Further, an S2 pole is arranged downstream of the N3 pole in the second rotational direction. The S2 pole functions as a draw-up pole for drawing up the developer from the first screw 233A. An N1 pole, an S1 pole and an N2 pole (second magnetic pole) are arranged downstream of the S2 pole in the second rotational direction. The N1 and S1 poles function as carrying poles for conveying the developer drawn up by the S2 pole toward the N2 pole. As shown in FIG. 18, the aforementioned layer thickness regulating member 235 is arranged upstream of the N2 pole in the second rotational direction and to face at a predetermined distance from the second sleeve 232B of the conveyor roller 232 between the S1 and N1 poles (near the N1 pole). Thus, a layer thickness of the developer can be stably regulated before the developer is transferred from the conveyor roller 232 to the developing roller 231.

Note that the N3 pole is a magnetic pole arranged downstream of the facing position TP in the second rotational direction and to face the N13 pole of the first magnet 231A and having the same polarity as the N13 pole. Further, the N2 pole is a magnetic pole arranged adjacent to and downstream of the N3 pole in the second rotational direction across the facing position TP and having the same polarity as the N3 pole. The developer supplied from the first screw 233A to the conveyor roller 232 and regulated by the layer thickness regulating member 235 is transferred from the conveyor roller 232 to the developing roller 231 by a magnetic field formed by the S11 pole of the first magnet 231A and the N2 pole of the second magnet 231. Further, when viewed in a cross-section perpendicular to the axial center of the developing roller 231 (FIG. 18), the N12 and N13 poles of the first magnet 231A and the N3 pole of the second magnet 232A are substantially linearly arranged along a straight line extending from an upper-left side to a lower-right side. Further, the S2 pole as the draw-up pole is arranged on the above straight line and an extension of the N3 pole.

Further, the second screw 233B is arranged above the first screw 233A in conformity with this oblique arrangement of the magnetic poles. In other words, a rotation axis center of the second screw 233B and that of the first screw 233A are also arranged in different levels along a straight line extending from an upper-left side toward a lower-right side.

Table 15 shows angles and magnetic forces (peak values of radial components) of five magnetic poles as an example of the second magnet 232A according to this embodiment. The angle of each magnetic pole shown in Table 15 is shown along the second rotational direction with the facing position TP of FIG. 20 as a starting point (angle) 0°. Note that a straight line CL connecting the facing position TP and a rotation axis center of the conveyor roller 232 (straight line connecting the rotation axis center of the developing roller 231 and that of the conveyor roller 232) is shown in FIG. 20 as the starting point.

TABLE 15

| MAGNETIC POLE | ANGLE | MAGNETIC FORCE |
|---|---|---|
| S2 | 140° | 45 mT |
| N1 | 200° | 45 mT |
| S1 | 270° | 60 mT |
| N2 | 330° | 45 mT |
| N3 | 30° | 65 mT |

With reference to FIG. 18, the partition plate 234 extends leftward in a curved manner after extending upward along the peripheral surface of the second screw 233B from a bottom part of the housing 23H. A tip part of the partition plate 234 supports a base end part of the separator 236. In this embodiment, the separator 236 vertically extends. Thus, the accumulation of the developer on the separator 236 is suppressed. Further, a tip part of the separator 236 is arranged to face the developing roller 231 in a range from the peak position of the N12 pole to that of the N13 pole in a circumferential distribution of the radial component of the magnetic force of the first magnet 231A. Thus, as shown in FIG. 18, a housing space 23S of the housing 23H is laterally divided into two at a position below the developing roller 231 by the separator 236 and the partition plate 234.

Also in this embodiment, it is suitably suppressed that a toner layer is formed on the developing roller 231, which is one roller facing the photoconductive drum 20, and ghost images as described above are generated in the developing device 23 in which two magnetic rollers (developing roller 231, conveyor roller 232) are arranged. Specifically, the developing roller 231 of the developing device 23 has the aforementioned N12 and N13 poles to suppress such ghost images. Further, the conveyor roller 232 has the N3 pole facing the N13 pole. In this case, with reference to FIG. 18, the developer conveyed from the S12 pole to the N12 pole of the developing roller 231 is partially retained on the N12 pole since the developer is less likely to move to the N13 pole. As a result, the retention portion TD of the developer is formed on the first sleeve 231B of the developing roller 231. In the retention portion TD, the magnetic brush of the developer is retained while slipping on the first sleeve 231B. Thus, even if the history of the toner consumed at the developing position NP remains in the toner layer on the first sleeve 231B, the history of the toner is eliminated (polished) by the magnetic brush of the developer retained in the retention portion TD. Thus, the developing device 23 having the generation of ghosts as described above suppressed is provided. Particularly, when a peak position of a magnetic force is not present at the facing position TP between the developing roller 231 and the conveyor roller 232 as in this embodiment, a polishing force (scraping force) of the magnetic brush of the developer on the conveyor roller 232 is less likely to reach the surface of the first sleeve 231B. Even in such a case, the retention portion TD can be suitably formed by the repulsive force of the N12 and N13 poles provided in the developing roller 231. Further, the N3 pole arranged to face the N13 pole is a magnetic pole having the same polarity as the N12 and N13 poles. Thus, excess developer that can be no longer held in the retention portion TD can be peeled from the first screw 231B by a repulsive force. Thus, it is suppressed that the developer having passed through the developing position NP is transferred toward the conveyor roller 232. As a result, the transfer of the developer from the conveyor roller 232 to the developing roller 231 by the N2 and S11 poles is stably realized and the scattering of the toner around the facing position TP is suppressed. Furthermore, in this embodiment, the separator 236 is arranged between the N12 and N13 poles. Thus, the developer can be stably peeled from the first screw 231B also by the above action of the repulsive force. Further, the adhesion of the developer to the conveyor roller 232 is further suppressed.

Note that if the developer on the developing roller 231 is collected by the conveyor roller 232, the flow of the magnetic brush from the developing roller 231 toward the conveyor roller 232 and that of the magnetic brush from the conveyor roller 232 toward the developing roller 231 approach around the facing position TP. In this case, the toner easily scatters by the collision of the both magnetic brushes. In this embodiment, the occurrence of such toner scattering is suitably suppressed.

Further, in this embodiment, the N12, N13 and N3 poles are arranged substantially on one straight line when viewed in a cross-section perpendicular to the axial center of the developing roller 231. Thus, the retention portion TD of the developer can be stably formed on the first screw 231B of the developing roller 231 and the developer can be stably peeled from the first screw 231B by the repulsive magnetic field formed by the N12, N13 and N3 poles.

Figure 21:
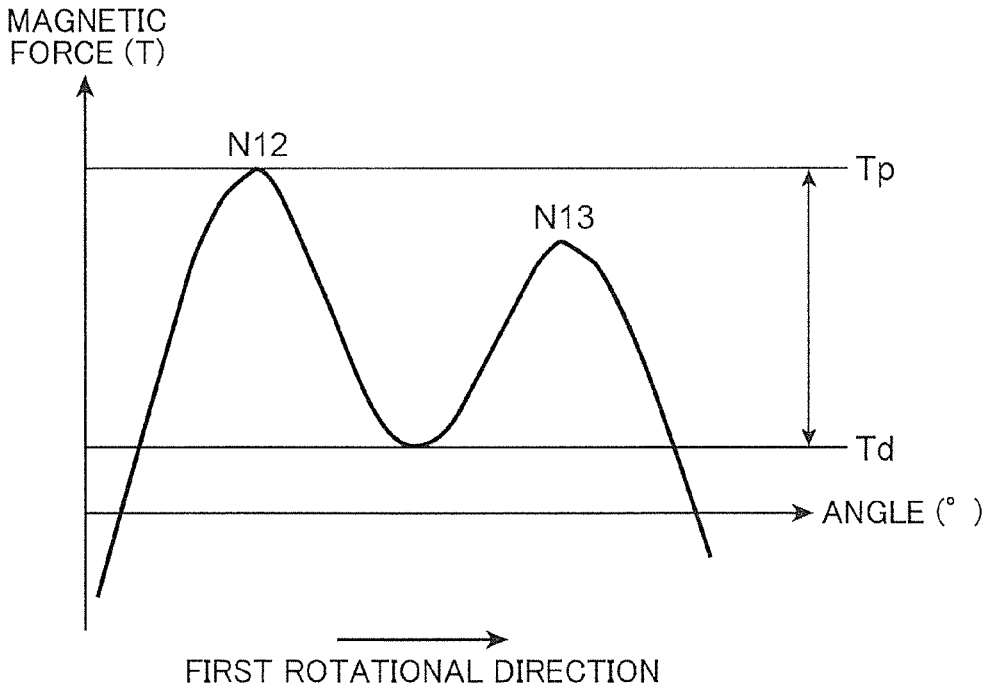
FIG. 21 is a graph showing a magnetic force distribution of a radial component between adjacent poles having the same polarity in the developing roller of the developing device according to the third embodiment of the present disclosure.

FIG. 21 is a graph showing a magnetic force distribution of a radial component between the N12 and N13 poles, which are adjacent magnetic poles having the same polarity, in the developing roller 231 of the developing device 23 according to this embodiment. In this embodiment, a relationship of:

$$Tp-Td \geq 25 \quad \text{(Equation 2)}$$

is satisfied when Tp (mT) denotes a peak magnetic force of the N2 pole and Td (mT) denotes a minimum value of the magnetic force (trough part of the magnetic force) between the peak position of the N12 pole and that of the N13 pole in a circumferential distribution of a radial component of the magnetic force of the first magnet 231A. By setting a large difference between the peak magnetic force Tp of the N12 pole and the magnetic force Td of the trough part between the N12 and N13 poles in this way, the repulsive magnetic force formed by the N12 and N13 poles further increases. Thus, the history on the toner layer generated at the developing position NP can be more stably eliminated. Note that the retention portion TD cannot be sufficiently formed by the known peeling pole for the developer. By successively arranging the three magnetic poles having the same polarity and satisfying Equation 2 as described above, the retention portion TD capable of polishing the toner layer on the first screw 231B can be formed.

In this embodiment, each of the N12 and N13 poles is formed of a fan-shaped ferrite magnet. A magnetic force difference between the peak value of the N12 pole and that of the N13 pole is set in a range of 30 mT or less. Within this range, how the retention portion TD is formed can be judged based on a comparison of the peak value Tp of the N12 pole on an upstream side and the magnetic force Td of the trough part. Note that the peak value of the N12 pole is desirably set equal to or larger than that of the N13 pole to more stably form the retention portion TD.

Further, in this embodiment, the S11 pole is arranged downstream of the N13 pole in the first rotational direction and the N2 pole is arranged upstream of the N3 pole in the second rotational direction. The developer can be stably supplied from the conveyor roller 232 to the developing roller 231 by a magnetic field formed by the N2 and S11 poles having different polarities. At this time, since the N2 and N3 poles having the same polarity are formed at positions across the facing position TP, the developer on the conveyor roller 232 can be pushed up toward the developing roller 231 by a repulsive magnetic field by the both poles. Further, the developer having moved toward the S11 pole is quickly conveyed toward the N11 pole according to the rotation of the first screw 231B by a repulsive magnetic field formed by the N2, N3 and N13 poles. In other words, it is suppressed that the developer having moved toward the S11 pole is clogged at the facing position TP. Note that, in this embodiment, a gap between the developing roller 231 and the photoconductive drum 20 (developing position NP) is set is set to be larger than 0.25 mm and not larger than 0.40 mm as an example. On the other hand, a gap between the developing roller 231 and the conveyor roller 232 (facing position TP) is set to be not smaller than 0.18 mm and not larger than 0.25 mm. In other words, the gap between the developing roller 231 and the conveyor roller 232 is set to be narrower than the gap between the developing roller 231 and the photoconductive drum 20. Note that the peak position of none of the magnetic poles is facing the facing position TP as described above. Thus, even if the gap of the facing position TP is set to be narrow as described above, it is suppressed that the developer present at the facing position TP is fixed.

Further, in this embodiment, the developer peeled from the developing roller 231 is collected not by the first screw 233A, but by the second screw 233B. In this case, the second conveying member 233B can be arranged at a position near (above) the developing roller 231 as shown in FIG. 18 as compared to the case where the developer peeled from the developing roller 231 is collected by the first screw 233A. Thus, the scattering of the toner from the developer after peeling is suppressed. Therefore, it is also suppressed that the toner scatters into the interior of the image forming apparatus 10 through a clearance of the housing 23H of the developing device 23 and the like.

Note that the first screw 233A needs to be shifted more leftward than in FIG. 18 in the case of collecting the developer peeled from the developing roller 231 by the first screw 233A. In this case, a function of supplying the developer from the first screw 233A to the conveyor roller 232 tends to be reduced. Further, the first screw 233A can have two functions of supplying and collecting the developer by increasing an outer diameter of the first screw 233A, but the entire developing device 23 is enlarged in this case.

Further, in this embodiment, the axial center of the developing roller 231 is arranged below that of the photoconductive drum 20 and the axial center of the conveyor roller 232 is arranged below that of the developing roller 231. Thus, the developer overflowing from the retention portion TD of the developer can be caused to fall and collected by a gravitational action. Further, with reference to FIG. 18, an outer diameter of the developing roller 231 and that of the conveyor roller 232 are substantially equal, the axial center of the developing roller 231 is arranged to the left of and at a predetermined distance from that of the photoconductive drum 20 and the axial center of the conveyor roller 232 is arranged between that of the developing roller 231 and that of the photoconductive drum 20 in the horizontal direction. Thus, the conveyor roller 232 is not arranged right below the developing roller 231, wherefore a space where the conveyor roller 232 is not present is formed below the N12 and N13 poles. Therefore, it is further suppressed that the developer peeled from the developing roller 231 adheres to the conveyor roller 232.

Next, the third embodiment of the present disclosure is further described on the basis of examples. Note that the present disclosure is not limited to the following examples.

<Experiment>

This experiment was conducted under the following experimental conditions.

<Experimental Conditions>

Photoconductive drum 20: amorphous silicon photoconductor (a-Si) having a diameter it, of 30 mm, a surface potential Vo=270 V and a circumferential speed=300 mm/sec Gap between layer thickness regulating member 235 and second sleeve 232B: 300 um Developer conveyance amount (after layer thickness regulation) on developing roller 231: 250 g/m$^2$ Carrier: a volume average particle diameter of 35 μm, a magnetic force of 80 emu/g Toner: a volume average particle diameter of 6.8 μm, a toner density of 7%

Conditions of the developing roller 231 used in the experiment are as follows.

Developing roller 231: a diameter φ of 20 mm

Circumferential speed ratio of the developing roller 231 to photoconductive drum 20: 1.6

Gap between developing roller 231 and photoconductive drum 20: 300

Development bias: DC bias=170 V, AC bias=Vpp 1.4 kV, a frequency f of 4.7 kHz, a duty ratio of 50%, rectangular wave (note that the development bias of the conveyor roller 232 also has the same potential)

Surface conditions of first sleeve 231B:

(Condition 3) Knurled V grooves (groove depth of 80 μm, groove width of 0.2 mm, the number of grooves of 120)

(Condition 4) Sandblasting (Rzjis =10 μm)

Further, a magnetic pole distribution of the developing roller 231 used in the experiment is as shown in the previous Table 14. Note that the following magnetic force measurement of the developing roller 231 and the conveyor roller 232 was conducted using a GAUSS METER Model GX-100 produced by Nihon Denji Sokki Co., Ltd.

Further, conditions of the conveyor roller 232 used in the experiment are as follows.

Conveyor roller 232: a diameter φ of 20 mm

Surface conditions of second sleeve 232B: knurled V grooves (groove depth of 80 μm, groove width of 0.2 mm, the number of grooves of 120)

Circumferential speed ratio of conveyor roller 232 to developing roller 231: 1.05

Gap between conveyor roller 232 and developing roller 231: 250 μm

Further, a magnetic pole distribution of the conveyor roller 232 used in the experiment is as shown in the previous Table 15.

This experiment was conducted with a relationship of a magnetic force difference Tp-Td in the first magnet 231A changed under the above conditions. Table 16 shows a list of examples and comparative examples of this experiment and evaluation results of development ghosts (ghost images) under the respective conditions.

TABLE 16

| EXPERIMENT | SLEEVE SURFACE PROCESSING | MAGNETIC FORCE DIFFERENCE (Tp − Td) | GHOST EVALUATION |
|---|---|---|---|
| COMPARATIVE EXAMPLE 3-1 | KNURLING | 20 mT | 2 |
| EXAMPLE 3-1 | KNURLING | 25 mT | 3 |
| EXAMPLE 3-2 | KNURLING | 30 mT | 4 |
| EXAMPLE 3-3 | KNURLING | 35 mT | 4 |
| COMPARATIVE EXAMPLE 3-2 | BLASTING(Rz8 μm) | 20 mT | 2 |
| EXAMPLE 3-4 | BLASTING(Rz8 μm) | 25 mT | 4 |
| EXAMPLE 3-5 | BLASTING(Rz8 μm) | 30 mT | 5 |
| EXAMPLE 3-6 | BLASTING(Rz8 μm) | 35 mT | 5 |

Note that a development ghost generation level is visually ranked based on the following criteria after a pattern image as shown in FIG. 8 is printed and a level of 3 or higher is determined to be an OK level.

5: Not at all (no problem in actual use)

4: Confirmable upon close examination, but not annoying (no problem in actual use)

3: Generated, but not alloying (no problem in actual use)

2: Confirmable

1: Clearly confirmable

In Comparative Example 3-1, the magnetic force difference between Tp and Td was small and the retention portion TD (FIG. 18) of the developer was not sufficiently formed. Thus, development ghosts were generated. Further, in Examples 3-1, 3-2 and 3-3, the magnetic force difference between Tp and Td was sufficient and the conveyance of the developer from the N12 pole to N13 pole is temporarily obstructed. Thus, the retention portion TD of the developer was sufficiently formed. As a result, the generation of development ghosts was suppressed. On the other hand, in Comparative Example 3-2, conveyance performance of the first sleeve 231B of the developing roller 231 was reduced and the retention portion TD was more easily formed as compared to Comparative Example 3-1, but the magnetic force difference between Tp and Td was small. Thus, the retention portion TD was not sufficiently formed and development ghosts were generated. In Examples 3-4, 3-5 and 3-6, since the conveyance performance of the first sleeve 231B was reduced as compared to Examples 3-1, 3-2 and 3-3, the retention portion TD of the developer was notably formed and development ghosts were further improved.

Note that Condition 4 of the first sleeve 231B was found to give results similar to the above as a result of conducting a similar evaluation in a Rzjis range of not smaller than 4 μm and not larger than 14 μm.

Although the developing devices 23 according to the respective embodiments of the present disclosure and the image forming apparatuses 10 provided with these have been described in detail above, the present disclosure is not limited to this. The present disclosure can be, for example, modified as follows.

(1) Although the N4 and N5 poles are described as two facing magnetic poles having the same polarity in the first and second magnets 231A, 232A in the above first embodiment, the present disclosure is not limited to this. Two adjacent magnetic poles having the same polarity may be composed of S poles. In this case, other magnetic poles around the facing position TP may be reversed between the S and N poles.

(2) Although the layer thickness regulating member 235 is arranged to face the conveyor roller 232 in each of the above embodiments, the present disclosure is not limited to this. The layer thickness regulating member 235 may be arranged to face the vicinity of the S1 pole of the developing roller 231 or the like. In this case, the first magnet 231A may additionally have another magnetic pole for carrying the developer.

(3) Although the N13, N1 and N4 poles are described as three magnetic poles having a polarity different from the S11 pole in the first and second magnets 231A, 232A in the above second embodiment, the present disclosure is not limited to this. An N pole may be arranged at the position of the Sil pole and S poles may be arranged at the positions of the N13, N1 and N4 poles. In this case, other magnetic poles of the first and second magnets 231A, 232A may be reversed between the S and N poles.

(4) Further, although the developing roller 231, the conveyor roller 232 and the layer thickness regulating member 235 are set at the same potential in the above each embodiment and the examples thereof, the present disclosure is not limited to this. Individual development biases may be applied to the developing roller 231 and the conveyor roller 232. Further, the layer thickness regulating member 235 may be in a floating state in potential.

(5) Although the N12 and N13 poles are described as two adjacent magnetic poles having the same polarity in the first magnet 231A in the above third embodiment, the present disclosure is not limited to this. Two adjacent magnetic poles having the same polarity may be composed of S poles. In this case, other magnetic poles may be reversed between the S and N poles.

Figure 22:
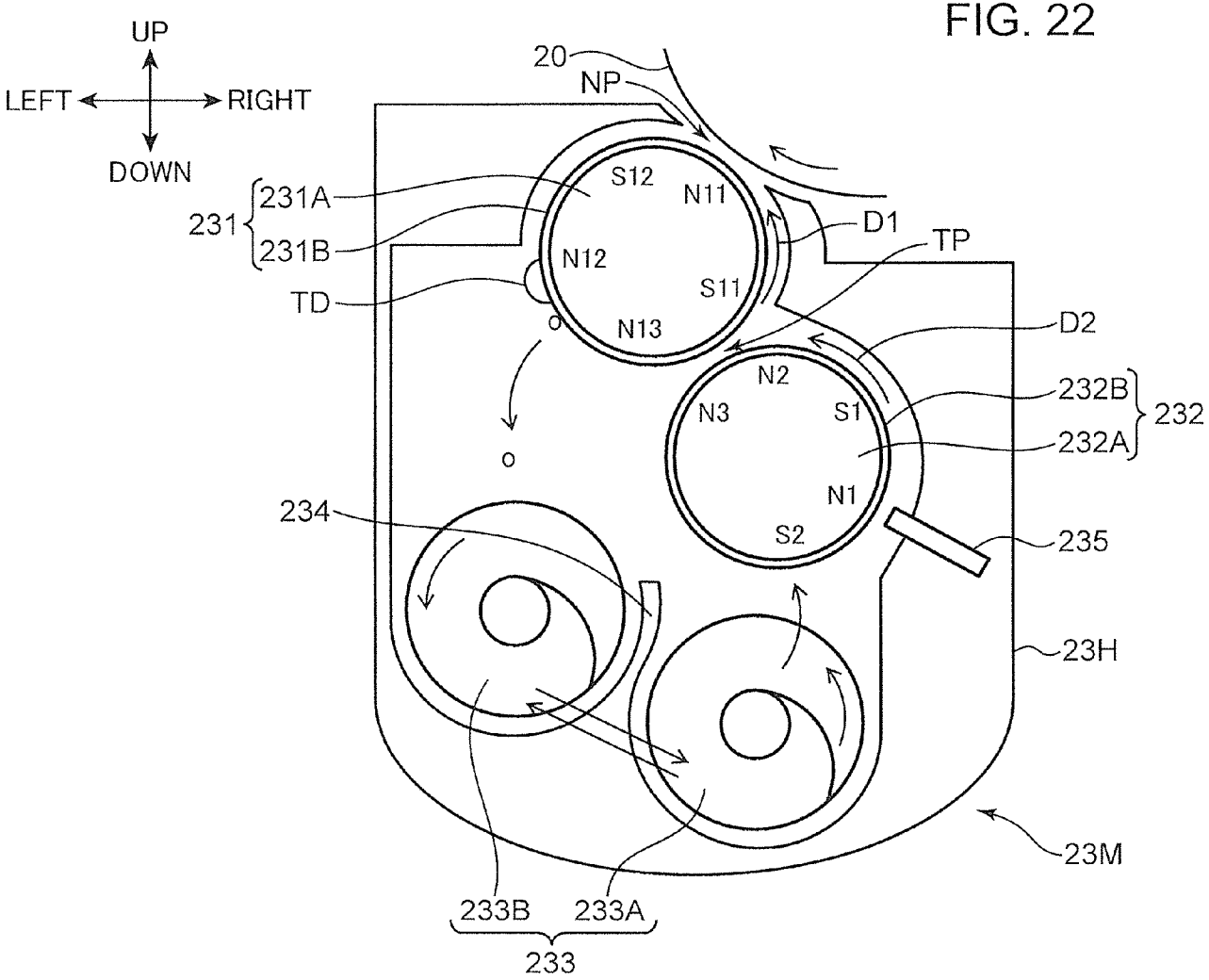
FIG. 22 is a schematic sectional view showing an internal structure of a developing device according to a modification of the present disclosure.

(6) Further, although the developing device 23 includes the separator 236 (FIG. 18) in the above third embodiment, the present disclosure is not limited to this. FIG. 22 is a schematic sectional view showing an internal structure of a developing device 23M according to a modification of the present disclosure. Note that, in FIG. 22, members having functions and structures similar to those of the developing device 23 according to the previous third embodiment are denoted by the same reference signs as in FIG. 18. The developing device 23M includes no separator 236 unlike the developing device 23 according to the previous third embodiment. Further, a partition plate 234 of the developing device 23M has a function of partitioning between a first screw 233A and a second screw 233B. Even in such a configuration, ghost images are suppressed by a retention portion of developer formed between N12 and N13 poles. Further, excess developer of the retention portion TD can be stably peeled from a first sleeve 231B by a repulsive magnetic field formed by the N12, N13 and N3 poles.

The invention claimed is:

1. A developing device, comprising:

a developing roller including a fixed first magnet having a plurality of magnetic poles along a circumferential direction and a first sleeve configured to rotate in a first rotational direction around the first magnet and carry developer containing toner and magnetic carrier on a peripheral surface, arranged to face a photoconductive drum, on a surface of which an electrostatic latent image is to be formed, at a predetermined developing position and configured to supply the toner to the photoconductive drum;

a conveyor roller including a fixed second magnet having a plurality of magnetic poles along a circumferential direction and a second sleeve configured to rotate in a second rotational direction around the second magnet and carry the developer on a peripheral surface, arranged to face the developing roller at a predetermined facing position and configured to supply the developer to the developing roller; and a developer stirring unit configured to stir the developer and supply the developer to the conveyor roller;

wherein:

the first and second rotational directions are set to be opposite to each other at the facing position;

the first magnet includes:

a first magnetic pole arranged upstream of the facing position in the first rotational direction; and a second magnetic pole arranged adjacent to and downstream of the first magnetic pole in the first rotational direction across the facing position; and the second magnet includes:

a third magnetic pole arranged upstream of the facing position in the second rotational direction; and a fourth magnetic pole arranged adjacent to and downstream of the third magnetic pole in the second rotational direction across the facing position;

the first and fourth magnetic poles are magnetic poles having the same polarity;

one of the second and third magnetic poles is a magnetic pole having the same polarity as the first magnetic pole;

the other of the second and third magnetic poles is a magnetic pole having a polarity different from the first magnetic pole;

the developer supplied from the developer stirring unit to the conveyor roller is transferred from the conveyor roller to the developing roller by a magnetic field formed by the third and second magnetic poles; and the developer having passed through the developing position is transferred from the developing roller to the conveyor roller by a magnetic field formed by the first and fourth magnetic poles.

2. A developing device according to claim 1, wherein:

the second magnetic pole is a magnetic pole having the same polarity as the first magnetic pole and the third magnetic pole is a magnetic pole having a polarity different from the first magnetic pole.

3. A developing device according to claim 2, further comprising:

a layer thickness regulating member arranged to face the conveyor roller and configured to regulate a layer thickness of the developer supplied from the developer stirring unit to the conveyor roller, wherein:

a relationship of:

$$3.48 \leq \beta/\alpha 6.28 \ (\alpha=(A+C)/X,\ \beta=(A+B)/Y)$$

is satisfied if a position on a circumference of the first sleeve facing a peak position of the first magnetic pole is a first outer peripheral position, a position on the circumference of the first sleeve facing a peak position of the second magnetic pole is a second outer peripheral position, a position on a circumference of the second sleeve facing a peak position of the fourth magnetic pole is a third outer peripheral position, a linear distance between the first and third outer peripheral positions is X (mm), a distance on the peripheral surface of the first sleeve between the first and second outer peripheral positions is Y (mm), a peak magnetic force of the first magnetic pole is A (mT), a peak magnetic force of the second magnetic pole is B (mT), a peak magnetic force of the fourth magnetic pole is C (mT) and a conveyance amount of the developer regulated by the layer thickness regulating member is M ($g/m^2$) in radial components of magnetic forces of the first and second magnets when viewed in a cross-section perpendicular to an axial direction in the rotation of the developing roller and the conveyor roller.

4. A developing device according to claim 1, wherein:

the third magnetic pole is a magnetic pole having the same polarity as the first magnetic pole and the second magnetic pole is a magnetic pole having a polarity different from the first magnetic pole.

5. A developing device according to claim 4, wherein:

the second magnet further includes a fifth magnetic pole arranged downstream of the fourth magnetic pole in the second rotational direction and having a polarity different from the fourth magnetic pole; and the developer transferred from the developing roller to the conveyor roller is conveyed to a downstream side in the second rotational direction by a magnetic field formed by the fourth and fifth magnetic poles in addition to by the rotation of the second sleeve.

6. A developing device according to claim 1, wherein:

the first magnet includes a fifth magnetic pole arranged adjacent to and upstream of the first magnetic pole in the first rotational direction and having the same polarity as the first magnetic pole in a first region downstream of the developing position in the first rotational direction and upstream of the facing position in the first rotational direction.

7. A developing device according to claim 6, wherein:

a relationship of:

$$Tp-Td \geq 25$$

is satisfied when Tp (mT) denotes a peak magnetic force of the fifth magnetic pole and Td (mT) denotes a minimum value of a magnetic force between a peak position of the fifth magnetic pole and that of the first magnetic pole in a distribution in the circumferential direction of a radial component of the magnetic force of the first magnet.

8. A developing device according to claim 6, wherein:

the second magnet is a magnetic pole having a polarity different from the first magnetic pole and the third magnetic pole is a magnetic pole having the same polarity as the fourth magnetic pole.

9. A developing device according to claim 6, wherein:

the developer stirring unit includes:

a first conveying member configured to convey the developer in a predetermined direction along a horizontal direction and supply the developer to the conveyor roller; and a second conveying member configured to convey the developer in an opposite direction to that of the first conveying member along the horizontal direction and collect the developer peeled from the developing roller; and the developer is conveyed in a circulating manner by conveying forces of the first and second conveying members.

10. A developing device according to claim 6, further comprising:

a peeling member arranged to face the developing roller in a range from a peak position of the first magnetic pole to that of the second magnetic pole in a distribution in the circumferential direction of a radial component of a magnetic force of the first magnet.

11. A developing device according to claim 6, wherein:

an axial center of the developing roller is arranged at a predetermined distance from an axial center of the photoconductive drum on one end side in a horizontal direction and an axial center of the conveyor roller is arranged between that of the developer and that of the photoconductive drum in the horizontal direction when viewed in a cross-section perpendicular to the axial center of the developing roller.

12. A developing device according to claim 6, wherein:

the first, fourth and fifth magnetic poles are arranged substantially on one straight line when viewed in a cross-section perpendicular to an axial center of the developing roller.

13. A developing device according to claim 1, further comprising:

a layer thickness regulating member arranged to face the conveyor roller on a side upstream of the third magnetic pole in the second rotational direction and configured to regulate a layer thickness of the developer supplied from the developer stirring unit to the conveyor roller.

14. A developing device according to claim 1, further comprising a housing configured to rotatably support the developing roller and the conveyor roller, wherein:

the housing includes:

a first inner wall portion extending along the peripheral surface of the first sleeve of the developing roller from the developing position to a position facing the first magnetic pole; and a second inner wall portion connected to the first inner wall portion, facing the fourth magnetic pole and extending along the peripheral surface of the second sleeve of the conveyor roller.

15. A developing device according to claim 14, wherein:

the housing further includes:

a third inner wall portion extending along the peripheral surface of the first sleeve of the developing roller from the developing position to a position facing the second magnetic pole on a side opposite to the first inner wall portion; and a fourth inner wall portion connected to the third inner wall portion, facing the third magnetic pole and extending along the peripheral surface of the second sleeve of the conveyor roller.

16. A developing device according to claim 1, wherein:

the first sleeve of the developing roller includes a base member having blasting applied to a surface.

17. A developing device according to claim 16, wherein:

the first sleeve of the developing roller includes a plating layer applied to the surface of the base member.

18. A developing device according to claim 1, wherein:

an axial center of the developing roller is arranged below that of the photoconductive drum; and an axial center of the conveyor roller is arranged below that of the developing roller.

19. A developing device according to claim 1, wherein:

a development bias, in which an alternating-current bias is superimposed on a direct-current bias, is applied to the developing roller.

20. An image forming apparatus, comprising:

a developing device according to claim 1;

the photoconductive drum configured to receive the supply of the toner from the developing device and carry a toner image on the peripheral surface; and a transfer unit configured to transfer the toner image from the photoconductive drum to a sheet.

* * * * *